US010869115B2

(12) United States Patent
Cohen et al.

(10) Patent No.: US 10,869,115 B2
(45) Date of Patent: Dec. 15, 2020

(54) APPARATUS AND METHOD OF FORMING A CUSTOM EARPIECE

(71) Applicant: Logitech Europe S.A., Lausanne (CH)

(72) Inventors: Navi Cohen, San Jose, CA (US); Daniel Blumer, Cote St Luc (CA); Jose Froilan P. Lomotan, San Jose, CA (US); Kiran Phalak, Newark, CA (US); Jonathan Thuot, Fremont, CA (US)

(73) Assignee: LOGITECH EUROPE S.A., Lausanne (CH)

( * ) Notice: Subject to any disclaimer, the term of this patent is extended or adjusted under 35 U.S.C. 154(b) by 0 days.

(21) Appl. No.: 16/238,380

(22) Filed: Jan. 2, 2019

(65) Prior Publication Data

US 2019/0208304 A1 Jul. 4, 2019

Related U.S. Application Data

(60) Provisional application No. 62/613,397, filed on Jan. 3, 2018.

(51) Int. Cl.
*H04R 1/10* (2006.01)
*H04R 25/00* (2006.01)

(52) U.S. Cl.
CPC ..... *H04R 1/1016* (2013.01); *H04R 1/1041* (2013.01); *H04R 1/1058* (2013.01); (Continued)

(58) Field of Classification Search
CPC .... H04R 1/1058; H04R 25/65; H04R 25/652; H04R 25/658; H04R 2225/77
See application file for complete search history.

(56) References Cited

U.S. PATENT DOCUMENTS 2,535,258 A 12/1950 Bland
3,440,314 A 4/1969 Frisch
(Continued)

FOREIGN PATENT DOCUMENTS

CN 101919272 A 12/2010
CN 102473407 A 5/2012
(Continued)

OTHER PUBLICATIONS

International Search Report dated Mar. 6, 2019 for Application No. PCT/IB2019/050035.
(Continued)

*Primary Examiner* — Fan S Tsang
*Assistant Examiner* — Ryan Robinson
(74) *Attorney, Agent, or Firm* — Patterson & Sheridan, LLP

(57) ABSTRACT

Embodiments of the present disclosure generally relate to custom-fit in-ear audio devices, also referred to herein as in-ear audio devices, custom-fit earpieces, or simply earpieces. The following discloses embodiments of custom-fit earpieces that include features providing superior retention in a user's ear while also maintaining desirable comfort and sound quality. The superior retention is generally provided by a curable filler material disposed in a sleeve body that is deformed to conform to the shape of a user's ear as the curable filler material is cured. The comfort level of the custom-fit earpiece described herein is enhanced because the audio output member can move independently or relative to the portion of the earpiece that includes the curable filler material, thus allowing the audio output member to adjust to and comfortably fit within a given user's ear canal.

34 Claims, 26 Drawing Sheets

(52) U.S. Cl.
CPC ..... *H04R 1/1075* (2013.01); *H04R 25/652* (2013.01); *H04R 25/60* (2013.01); *H04R 2225/025* (2013.01); *H04R 2420/07* (2013.01)

(56) References Cited

U.S. PATENT DOCUMENTS 3,475,528 A 10/1969 Parks
4,163,877 A 8/1979 Schonstedt
4,657,106 A 4/1987 Hardt
4,712,245 A 12/1987 Lyregaard
4,800,636 A 1/1989 Topholm
4,834,211 A 5/1989 Bibby et al.
4,834,927 A 5/1989 Birkholz et al.
4,962,537 A 10/1990 Basel et al.
5,185,802 A 2/1993 Stanton
5,321,757 A 6/1994 Woodfill, Jr.
5,333,622 A 8/1994 Casali et al.
5,455,994 A 10/1995 Termeer et al.
5,530,763 A 6/1996 Aebi et al.
5,631,965 A 5/1997 Chang et al.
5,804,109 A * 9/1998 Perkins ..... H04R 25/652 264/222
6,310,961 B1 10/2001 Oliveira et al.
6,401,859 B1 6/2002 Widmer et al.
6,427,018 B1 7/2002 Keliiliki
6,432,247 B1 8/2002 Juneau et al.
6,772,853 B2 8/2004 Yang
6,829,365 B1 12/2004 Kim
7,116,795 B2 10/2006 Tuason et al.
7,231,056 B2 6/2007 Chen
7,251,335 B1 7/2007 Chen
7,317,806 B2 1/2008 Harvey et al.
7,489,794 B2 2/2009 Harvey
7,499,562 B2 3/2009 Shim
7,634,099 B2 12/2009 Harvey et al.
D628,990 S 12/2010 Pedersen
7,858,897 B2 12/2010 Beranger
D630,621 S 1/2011 Pedersen
D634,306 S 3/2011 Pedersen
7,971,338 B2 7/2011 Yang et al.
7,991,179 B2 * 8/2011 Drambarean ..... H04R 1/1016 381/325
8,194,911 B2 6/2012 Dyer et al.
8,515,115 B2 8/2013 Kelly et al.
8,630,436 B2 1/2014 Berg
8,666,102 B2 * 3/2014 Bruckhoff ..... A61F 11/008 381/328
8,682,001 B2 3/2014 Annunziato et al.
8,841,603 B1 9/2014 Blanton et al.
8,897,458 B2 11/2014 Parkins et al.
8,900,125 B2 12/2014 Berglund et al.
8,900,127 B2 12/2014 Berglund et al.
8,900,128 B2 12/2014 Berglund et al.
8,900,129 B2 12/2014 Berglund et al.
8,900,130 B2 12/2014 Berglund et al.
8,976,995 B2 3/2015 Berg
9,002,023 B2 4/2015 Gauger, Jr.
9,042,589 B2 5/2015 Depallens et al.
9,191,758 B2 11/2015 Depallens et al.
D744,456 S 12/2015 Pedersen
D773,440 S 12/2016 Pedersen
D773,441 S 12/2016 Pedersen
D774,021 S 12/2016 Pedersen
10,021,496 B2 7/2018 Clausen et al.
10,034,105 B2 * 7/2018 Higgins ..... H04R 1/1058
10,158,933 B2 * 12/2018 Prevoir ..... B29C 35/0805
10,284,975 B2 * 5/2019 Higgins ..... H04R 25/652
2003/0000706 A1 1/2003 Carstensen
2006/0133636 A1 6/2006 Harvey et al.
2006/0159279 A1 7/2006 Kuo et al.
2006/0188119 A1 * 8/2006 Parker ..... H04R 25/652 381/322
2006/0281502 A1 12/2006 Chang et al.
2007/0036385 A1 2/2007 Harvey et al.
2008/0044034 A1 2/2008 Hou
2008/0119244 A1 5/2008 Malhotra
2009/0173353 A1 7/2009 Purcell et al.
2009/0233652 A1 9/2009 Yang
2009/0279731 A1 11/2009 Wu
2010/0019417 A1 1/2010 Chua et al.
2010/0278364 A1 11/2010 Berg
2011/0002491 A1 1/2011 Klemenz et al.
2011/0058702 A1 3/2011 Saggio, Jr.
2011/0159229 A1 6/2011 Doehle et al.
2011/0228963 A1 9/2011 Goldstein et al.
2012/0028107 A1 2/2012 Sugita et al.
2012/0237068 A1 9/2012 Fretz et al.
2013/0202141 A1 8/2013 Basseas
2013/0243209 A1 9/2013 Zurbruegg et al.
2013/0251186 A1 9/2013 Matsuo et al.
2013/0269448 A1 10/2013 Berger et al.
2013/0294634 A1 11/2013 Chen
2014/0003644 A1 1/2014 Keady et al.
2014/0105431 A1 4/2014 Berg
2014/0313506 A1 10/2014 Bergman et al.
2015/0038850 A1 2/2015 Hatzilias et al.
2015/0038871 A1 2/2015 Hatzilias et al.
2015/0038880 A1 2/2015 Hatzilias et al.
2015/0039087 A1 2/2015 Hatzilias et al.
2015/0057533 A1 2/2015 Bergman et al.
2015/0067929 A1 3/2015 Blanton et al.
2015/0097929 A1 4/2015 Bergman et al.
2015/0097931 A1 4/2015 Hatzilias et al.
2015/0097935 A1 4/2015 Hatzilias et al.
2015/0097968 A1 4/2015 Bergman et al.
2015/0098636 A1 4/2015 Bergman et al.
2015/0099981 A1 4/2015 Cahall et al.
2015/0099983 A1 4/2015 Hatzilias et al.
2015/0190043 A1 7/2015 Hatzilias
2015/0215693 A1 7/2015 Sandanger
2015/0281822 A1 10/2015 Berg
2015/0312665 A1 10/2015 Berg
2015/0374480 A1 12/2015 Grewe
2016/0051134 A1 2/2016 Hatzilias
2016/0205456 A1 7/2016 Berg
2016/0317352 A1 * 11/2016 Blumer ..... H04R 25/60
2017/0134844 A1 5/2017 Liu et al.
2017/0311069 A1 10/2017 Prevoir et al.
2018/0332379 A1 * 11/2018 McGarry ..... H04R 1/1016
2019/0253783 A1 * 8/2019 O'Callaghan ..... H04R 1/1058

FOREIGN PATENT DOCUMENTS

CN 103269466 A 8/2013
CN 103384356 A 11/2013
CN 204518015 U 7/2015
EP 2268063 A1 12/2010
EP 3188510 A1 7/2017
JP S63276398 A 11/1988
JP 2008236147 A 10/2008
WO 01/43495 A2 6/2001
WO 2005/125280 A2 12/2005
WO 2011022358 A1 2/2011
WO 2012/129229 A2 9/2012
WO 2013/138078 A2 9/2013
WO 2013/138079 A3 9/2013
WO 2015/030861 A1 3/2015
WO 2015/030862 A1 3/2015
WO 2015/179975 A1 12/2015

OTHER PUBLICATIONS

Extended European Search Report dated Nov. 13, 2017 in European Patent Application No. 15799822.0 (European Publication No. ), pages.
Australian action dated Oct. 15, 2018 for Application No. 2015268066.
International Search Report PCT/CA2015/050479.
International Preliminary Report PCT/CA2015/050479.
Chinese First Office Action dated Aug. 31, 2018 for Application No. 201580041252.1.

* cited by examiner

APPARATUS AND METHOD OF FORMING A CUSTOM EARPIECE

CROSS-REFERENCE TO RELATED APPLICATIONS

This application claims the benefit of U.S. provisional patent application Ser. No. 62/613,397, filed Jan. 3, 2018, which is herein incorporated by reference.

BACKGROUND

Field

Embodiments of the present disclosure generally relate to custom-fit earpieces and methods for customizing an earpiece for use in a user's ear.

Description of the Related Art

Audio devices allow users to receive audio content or audio information from various media sources, such as internet, video players, gaming devices, music playing platforms or other types of audio generating devices. Typical portable in-ear audio devices may include various tethered and wireless headphones or other similar devices. Some common types of in-ear audio devices include earphones, in-ear monitors, and hearing aids. Listening devices, such as earphones and in-ear monitors can be hard-wired or wirelessly connected to an audio source to listen to audio provided to the device.

It is generally preferable to customize the shape of an in-ear audio device to a user's ear, so that the in-ear audio device is comfortable to wear, the in-ear audio device is easily retained in the user's ear, and any surrounding ambient noise can be eliminated or controlled when the in-ear audio device is inserted within the user's ear. Traditionally, custom-fit in-ear audio devices have used a wax-molding process to tailor the in-ear audio device to the unique shape of a user's ear. Although this wax-molding process can achieve a well-fitting custom in-ear audio device for a user, the process can be time-consuming and expensive. The process may require the user to travel to a location where a business can perform the wax molding of the user's ear. Then the user must wait multiple days until the custom in-ear audio device can be produced based on the wax molding and then sent to the user.

Therefore, there is a need for an improved custom-fit in-ear audio device and method of customizing the in-ear audio device that overcomes the deficiencies described above.

SUMMARY

Embodiments of the disclosure may provide an audio device that includes an audio assembly comprising an audio speaker, and an ear insert connected to the audio assembly. The ear insert may include a sleeve body, one or more light sources disposed inside the sleeve body, a sound tube disposed inside the sleeve body, wherein an output of the audio speaker is connected to an input of the sound tube, and a curable filler material disposed inside the sleeve body and around the sound tube, wherein the one or more light sources are disposed in the curable filler material.

Embodiments of the disclosure may provide an audio device that includes an audio assembly comprising an audio speaker, and an ear insert connected to the audio assembly.

The ear insert may include a sleeve body, a light reflective coating disposed on an inner surface of the sleeve body, a sound tube disposed inside the sleeve body, wherein an output of the audio speaker is connected to an input of the sound tube, and a curable filler material disposed inside the sleeve body and around the sound tube, wherein the one or more light sources are disposed outside of the curable filler material and adjacent to a surface of a portion of the sleeve body which does not include the light reflective coating.

Embodiments of the disclosure may further provide an audio device comprising an audio assembly comprising an audio speaker, and an ear insert connected to the audio assembly. The ear insert may include a sleeve coated with a first reflective material, one or more light sources disposed inside the sleeve, a sound tube disposed inside the sleeve, wherein the sound tube is coated with a second reflective material and an output of the audio speaker is connected to an input of the sound tube, and a curable filler material disposed inside the sleeve and around the sound tube.

Embodiments of the disclosure may provide an audio device that includes an audio assembly comprising an audio speaker, and an ear insert connected to the audio assembly. The ear insert may include a sleeve body including an ear tip having an output to direct audio to the user, a first light source, a sound tube disposed inside the sleeve body, wherein an output of the audio speaker is connected to an input of the sound tube, a curable filler material disposed inside the sleeve body and around the sound tube, and a fiber optic cable extending from one of the first light source to an interior portion of the ear tip of the sleeve body.

Embodiments of the disclosure may provide an audio device that includes an audio assembly comprising an audio speaker and an ear insert connected to the audio assembly. The ear insert may include a sleeve body including an ear tip having an output to direct audio to the user, a first light source, a sound tube assembly including a base and a sound tube having a length extending from the base to an output region of the sound tube, wherein the sound tube assembly is disposed inside the sleeve body, an output of the audio speaker is connected to an input of the sound tube, and the sound tube includes a first portion, a second portion, and a third portion spaced apart from each other along the length of the sound tube, wherein the first portion and the second portion are each more optically transparent than the second portion and second portion is disposed between the first portion and the third portion, and a curable filler material disposed inside the sleeve body and around the sound tube.

Embodiments of the disclosure may provide a method of forming a customizable ear insert comprising forming a sound tube, overmolding a sleeve body onto the sound tube, inserting the sound tube into the sleeve body by turning the sleeve body outside out, and adding a curable filler material to the interior of the sleeve body.

Embodiments of the disclosure may provide a method of forming a customizable ear insert comprising inserting a sound tube into an inner volume of a flexible sleeve body, wherein the flexible sleeve body comprises an ear tip portion for providing audio to a user and a collar to retain the sound tube in the inner volume, inserting a first flat tube through the collar of the flexible sleeve body to connect the inner volume of the flexible sleeve body to an external environment, expanding the first flat tube with a first catheter, and adding a curable filler material to the inner volume of the flexible sleeve body through the first catheter.

Embodiments of the disclosure may further provide an audio device, comprising two earphone assemblies, wherein each of the two earphone assemblies comprises an ear insert and an audio assembly. Each of the ear inserts in the two earphone assemblies comprise a sleeve body having an inner surface, and comprising an elastic material and a reflective material which is configured to reflect one or more wavelengths of light emitted by a radiation source, a sound tube that is coupled to the sleeve body, wherein the inner surface of the sleeve body and an outer surface of the sound tube at least partially define an inner volume of the ear insert, and a curable filler material disposed within the inner volume, wherein the curable filler material is configured to be cured by the one or more wavelengths of light emitted by the radiation source. Each of the audio assemblies in the two earphone assemblies comprise an audio driver configured to deliver audible sound to an inner surface of the sound tube. An external surface of the sleeve body of the ear insert in a first of the two earphone assemblies has a shape that is different from a shape of an external surface of the sleeve body of the ear insert in a second of the two earphone assemblies.

Embodiments of the disclosure may further provide an audio device that comprises an earphone assembly. The earphone assembly comprises an ear insert and an audio assembly. The ear insert comprises a sleeve body having an inner surface, and comprising an elastic material and a reflective material which is configured to reflect one or more wavelengths of light emitted by a radiation source, a sound tube that is coupled to the sleeve body, wherein the inner surface of the sleeve body and an outer surface of the sound tube at least partially define an inner volume of the ear insert, and a curable filler material disposed within the inner volume, wherein the curable filler material is configured to be cured by the one or more wavelengths of light emitted by the radiation source. The audio assembly comprises an audio driver configured to deliver audible sound to an inner surface of the sound tube. The audio assembly can be separably coupled to the ear insert.

Embodiments of the disclosure may further provide an audio device that comprises an earphone assembly. The earphone assembly comprises an ear insert and an audio assembly. The ear insert comprises a sleeve comprising an elastic material and having an inner surface, a sound tube that is coupled to the sleeve, wherein the inner surface of the sleeve and an outer surface of the sound tube at least partially define an inner volume of the ear insert, a curable filler material disposed within the inner volume, wherein the curable filler material is configured to be cured by one or more wavelengths of light emitted by a radiation source, and a reflective coating disposed over the inner surface of the sleeve, wherein the reflective coating is configured to reflect the one or more wavelengths of light emitted by the radiation source. The audio assembly comprises an audio driver configured to deliver audible sound to an inner surface of the sound tube, and a portable power source configured to power the audio driver and the radiation source.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to custom-fit in-ear audio devices, also referred to herein as in-ear audio devices, custom-fit earpieces, or simply earpieces. The following discloses embodiments of custom-fit earpieces that include features providing superior retention in a user's ear while also maintaining desirable comfort and sound quality. The superior retention is generally provided by a curable filler material disposed in a sleeve that is deformed to conform to the shape of a user's ear as the curable filler material is cured. The comfort level of the custom-fit earpiece described herein is enhanced because at least a portion of the audio output member can move independently or relative to the portion of the earpiece that includes the curable filler material, thus allowing the audio output member to adjust to and comfortably fit within a given user's ear canal.

The following disclosure includes embodiments that can improve a custom-fit in-ear audio device by reducing the size and/or configuration of certain components in the portable in-ear audio device, and by improving the reliability of the process of forming the custom-fit in-ear audio device. For example, the disclosed improvements, such as a reflective sound tube and including radiation sources (e.g., light-emitting diodes) within a curable filler material can allow for smaller radiation sources to be used. These smaller radiation sources produce less heat than larger radiation sources, which can be safer and more comfortable for users during the curing process, and can also allow for smaller heat sinks to be used. The reliability of the custom-fit in-ear audio device can also be improved by reducing the variability in curing rates of a curable filler material disposed at different locations in the custom-fit in-ear audio device. Variability in cure rates at different locations within custom-fit in-ear audio device can cause mechanical stresses that prevent the curable filler material from properly bonding to the surrounding sleeve. The variability in cure rates can be reduced by providing light more directly to the ear tip portion of the custom-fit in-ear audio device (i.e., the portion of the device that extends into a user's ear canal). The following also discloses embodiments that can improve the manufacturing process of forming the custom-fit earpieces, for example by manufacturing the custom-fit in-ear audio device with less manufacturing steps making the custom-fit in-ear audio device less expensive to manufacture.

Figure 1A:
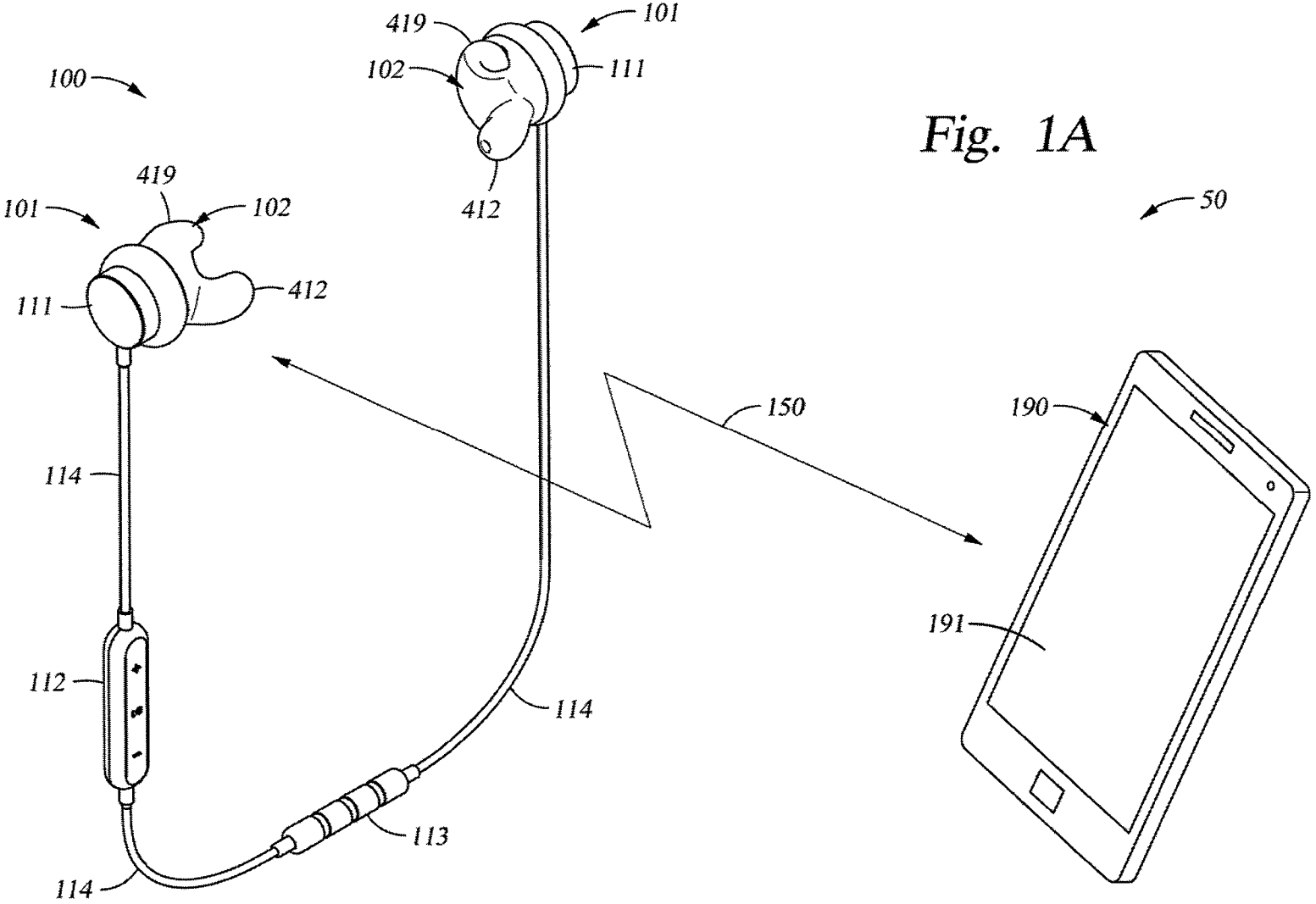
FIG. 1A is a perspective view of an audio device customization system, according to one embodiment.

FIG. 1A is a perspective view of an audio device customization system 50, according to one embodiment. The audio device customization system 50 includes an audio device 100 and an external electronic device 190. Although the audio device 100 is shown as wireless earphones in FIG. 1A, the audio device 100 described herein can include various types of in-ear audio devices for single-ear or dual-ear use, such as wired or wireless in-ear monitors, wired or wireless earbuds, hearing aids, and any other wearable devices that can be used to provide, block, and/or otherwise control sound that is received by a user's ear. Furthermore, although the external electronic device 190 is shown as a cell phone in FIG. 1A, the external electronic device 190 can include any external electronic device that can include a user interface 191 (e.g., a touchscreen display) and means of communicating with the audio device 100. In the audio device customization system 50 shown in FIG. 1A, the external electronic device 190 can be controlled by the user to control (e.g., initiate) and monitor a customization process performed on the audio device 100 to enable the earphones of the audio device 100 to be customized to an individual's ear(s). For example, the external electronic device 190 can communicate to the audio device 100 over a communication link 150 (e.g., a wireless communication link (e.g., Bluetooth® link)) to initiate a curing process on a curable filler material (e.g., a deformable photopolymer) within the earphones of the audio device 100. This communication can initiate the curing process by causing a radiation source (e.g., one or more light-emitting diodes (LEDs)) within the audio device 100 to be energized. Optionally, the curing process can be initiated as a user presses the earphones of the audio device 100 against the user's ears.

The audio device 100 includes two earphone assemblies 101. Each earphone assembly 101 includes a customizable ear insert 102 and an audio assembly 111. The two earphone assemblies 101 can be mirror images of each other so that one earphone assembly 101 is configured to be positioned within a user's left ear and one earphone assembly 101 is configured to be positioned within a user's right ear. The term "mirror image" as used herein is intended to describe components that are substantially similar to one another in an opposite orientation, and thus the term "mirror image" is not intended to be narrowly construed as an exact inverted copy. FIG. 1A provide an example in which the customizable ear inserts 102 are substantially similar to one another in an opposite orientation, since the ear tip portions 412 and the fin portion 419 are oppositely arranged so that one ear insert 102 can be inserted into a left ear and one ear insert 102 can be inserted into a right ear. In general, the two earphone assemblies 101 are "mirror images" before each customizable ear insert 102 is inserted into the user's ear, and thus distorted to fit the user's ear, and then cured, as is described in blocks 2010-2016 of FIG. 8 below. The customizable ear inserts 102 can be detachable from each corresponding audio assembly 111. Each customizable ear insert 102 can include a curable filler material disposed in a sleeve that can be at least partially deformed to conform to the shape of a user's ear during the curing process. Each audio assembly 111 can include an audio driver (i.e., audio speaker) and other components for providing audio to one of the user's ears through the corresponding customizable ear insert 102.

The audio device 100 further includes a controller assembly 112 and a connection assembly 113. The controller assembly 112 and the connection assembly 113 are connected to each other and to the earphone assemblies 101 by one or more cables 114. The cables 114, which are generally flexible, are configured to physically couple the controller assembly 112, the connection assembly 113 and the earphone assemblies 101 together, and also allow the transmission of electrical signals through one or more wires that form part of the various links 231-233 (FIG. 2) that extend between the controller assembly 112, the connection assembly 113 and the earphone assemblies 101. The controller assembly 112 can be used to control the operation of the audio device 100 during use by the user, for example, by starting and stopping audio output and adjusting volume. However, in some embodiments, the controller assembly 112 can be used for other operations, such as to initiate a curing process that is used to cause the customizable ear inserts 102 to conform to the shape of a user's ears with or without the use of an external electronic device 190. The connection assembly 113 can be used to charge power sources of the audio device 100, such as one or more on-board batteries, as well as to provide power to the radiation sources (e.g., light-emitting diodes) located within the customizable ear inserts 102 during the customization process. For example, the connection assembly 113 can be used to connect the audio device 100 to an external battery that is much larger (e.g., increased charge capacity, heavier) than any power source included of the audio device 100. This external power source can provide the energy for curing the curable filler material to conform the customizable ear inserts 102 to the individual shape of a user's ears.

Figure 1B:
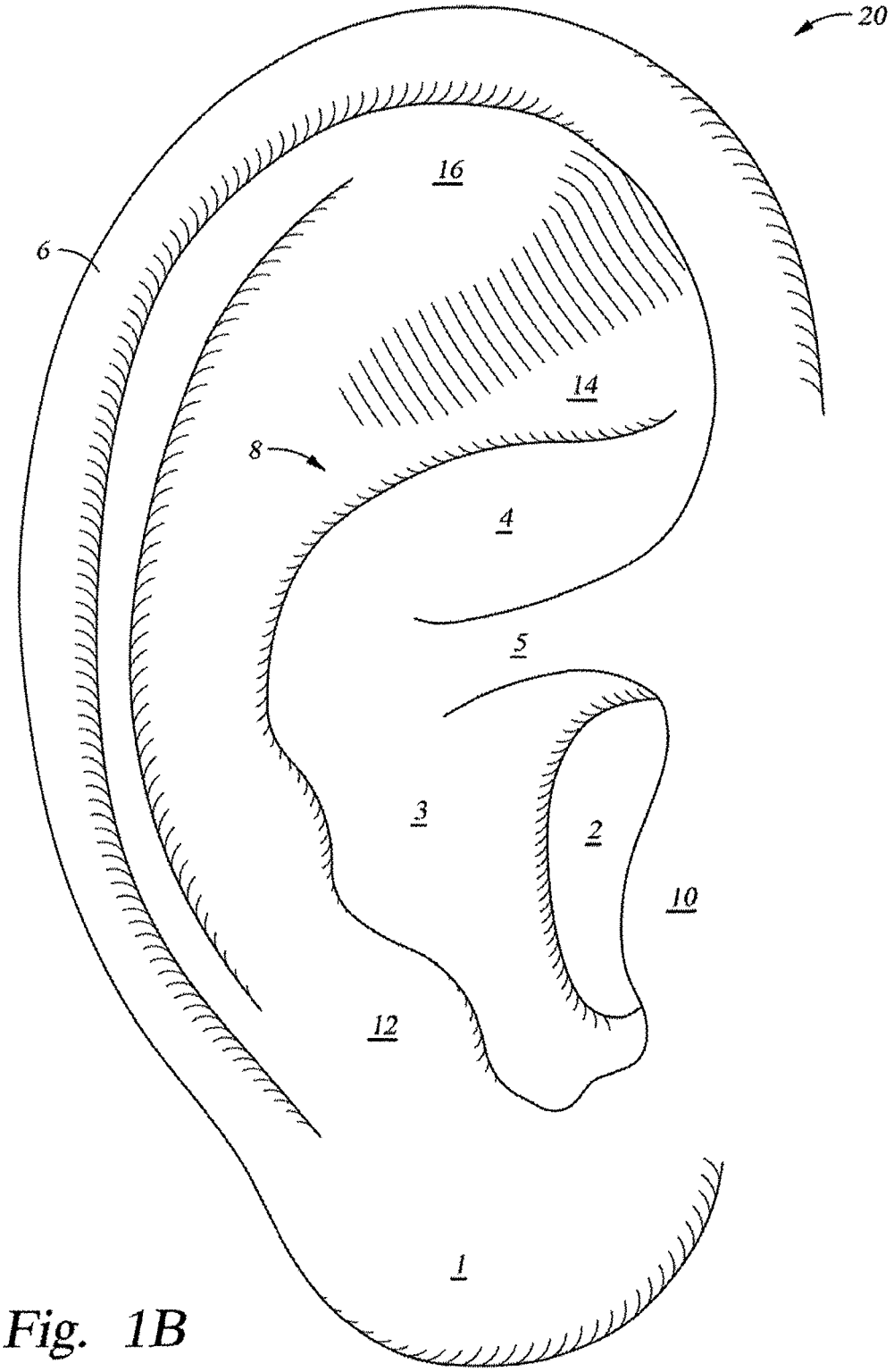
FIG. 1B is an exemplary illustration of a human outer ear.

FIG. 1B is an exemplary illustration of a human outer ear 20. The customizable ear insert 102 is configured to conform to portions of a user's ear 20 for a snug and comfortable fit. A description of these portions of the outer ear 20 follows and is useful for understanding how the customizable ear insert 102 conforms to a user's ear 20 in subsequent portions of this description.

The outer ear 20 includes an ear canal 2 leading to an ear drum (not shown). An ear lobe 1 forms a lower portion of the outer ear 20 and a helix 6 extends from the ear lobe 1 to a top portion of the outer ear 20. The ear canal 2 is surrounded by the cavum conchae 3, the crus helix 5, the tragus 10, and the antitragus 12. The cavum conchae 3 has a recessed shape (e.g., bowl shape) relative to the surrounding portions of the outer ear 20 other than the ear canal 2. The customizable ear insert 102 can be placed in this recessed shape of the cavum conchae 3 as more fully described below. The antitragus 12 is a projection extending from the ear lobe 1 towards the ear canal 2. The tragus 10 is a projection extending from the face (not shown) towards and/or over the ear canal 2. The crus helix 5 is a spiny portion extending from above the tragus 10 to the cavum conchae 3. The antihelix 8 is disposed between the helix 6 and the crus helix 5. The antihelix 8 is separated from the crus helix 5 by the cymba conchae 4, which is recessed relative to the crus helix 5 and the antihelix 8. The portion of the antihelix 8 that is connected to the cymba conchae 4 is the crus antihelicis inferioris 14. The portion of the antihelix 8 that extends to the helix 6 is the crus antihelicis superioris 16.

Figure 1C:
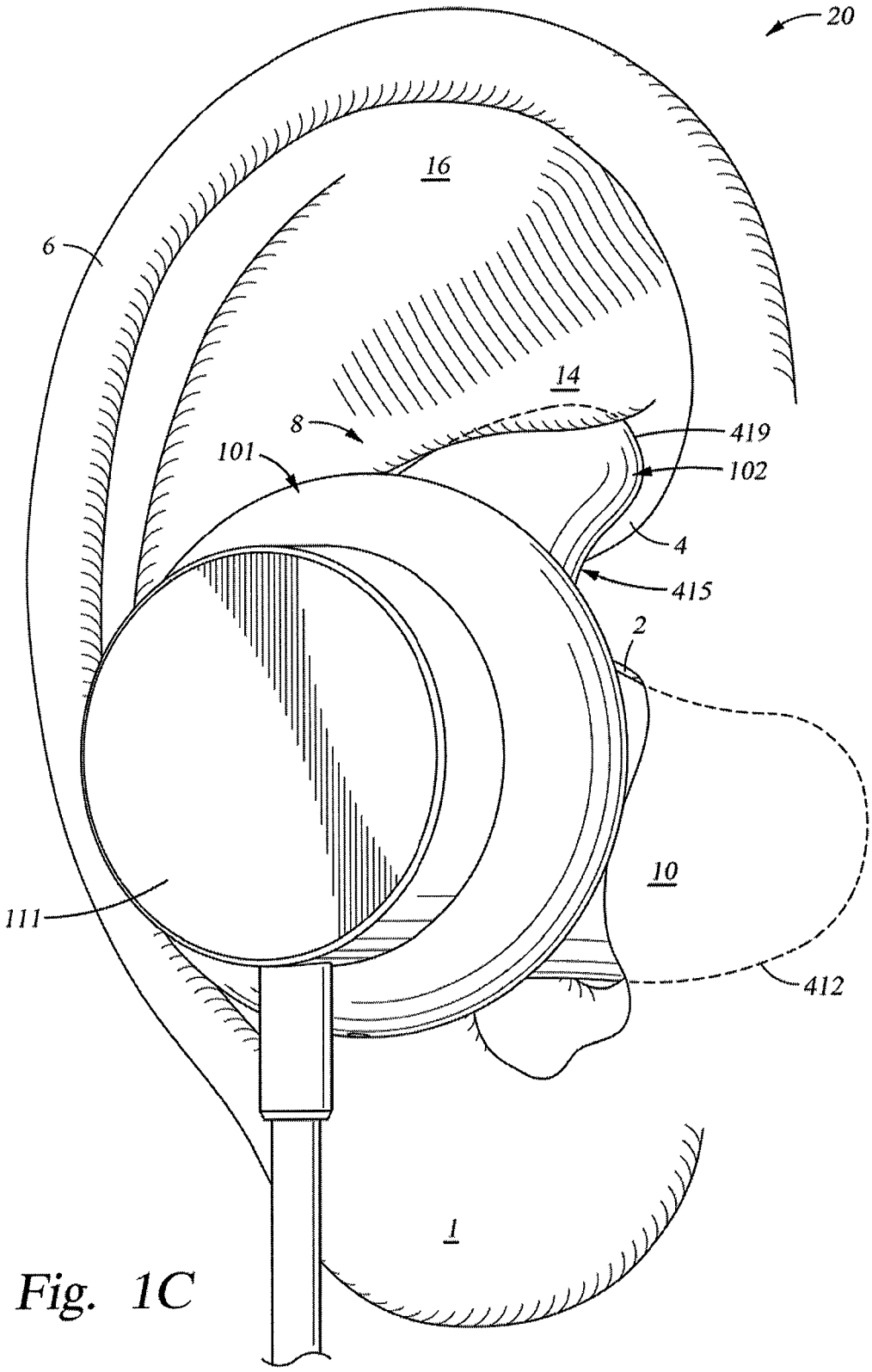
FIG. 1C is a perspective view of the earphone assembly disposed within a portion of the ear after a user customizes the earpiece to conform to the shape of the user's ear, according to one embodiment.

FIG. 1C is a perspective view of the earphone assembly 101 including the customizable ear insert 102 that is disposed within a portion of the outer ear 20 after a user customizes the customizable ear insert 102 to conform to the shape of the user's ear 20, according to one embodiment. The customizable ear insert 102 includes an ear tip portion 412 that has been positioned within and is conformed to the shape of the user's ear canal 2 and cavum conchae 3. The customizable ear insert 102 can further include a body portion 415 (FIG. 4) that is adapted to conformed to the shape of at least a portion of the user's cavum conchae 3, crus helix 5, and/or cymba conchae 4. The body portion 415 can further include a fin portion 419 that is opposite to the ear tip portion 412, and is adapted to rest against the cymba conchae 4 and under the antihelix 8 and/or the crus antihelicis inferioris 14 when the customizable ear insert 102 is disposed within a portion of the outer ear 20. The ear tip portion 412 and the body portion 415 can conform to the shapes of the different portions of the user's ear described above when the user presses the earphone assembly 101 towards the user's ear and a curable filler material inside the customizable ear insert is cured enabling the customizable ear insert to retain a shape that uniquely fits the ear of that user.

Figure 2:
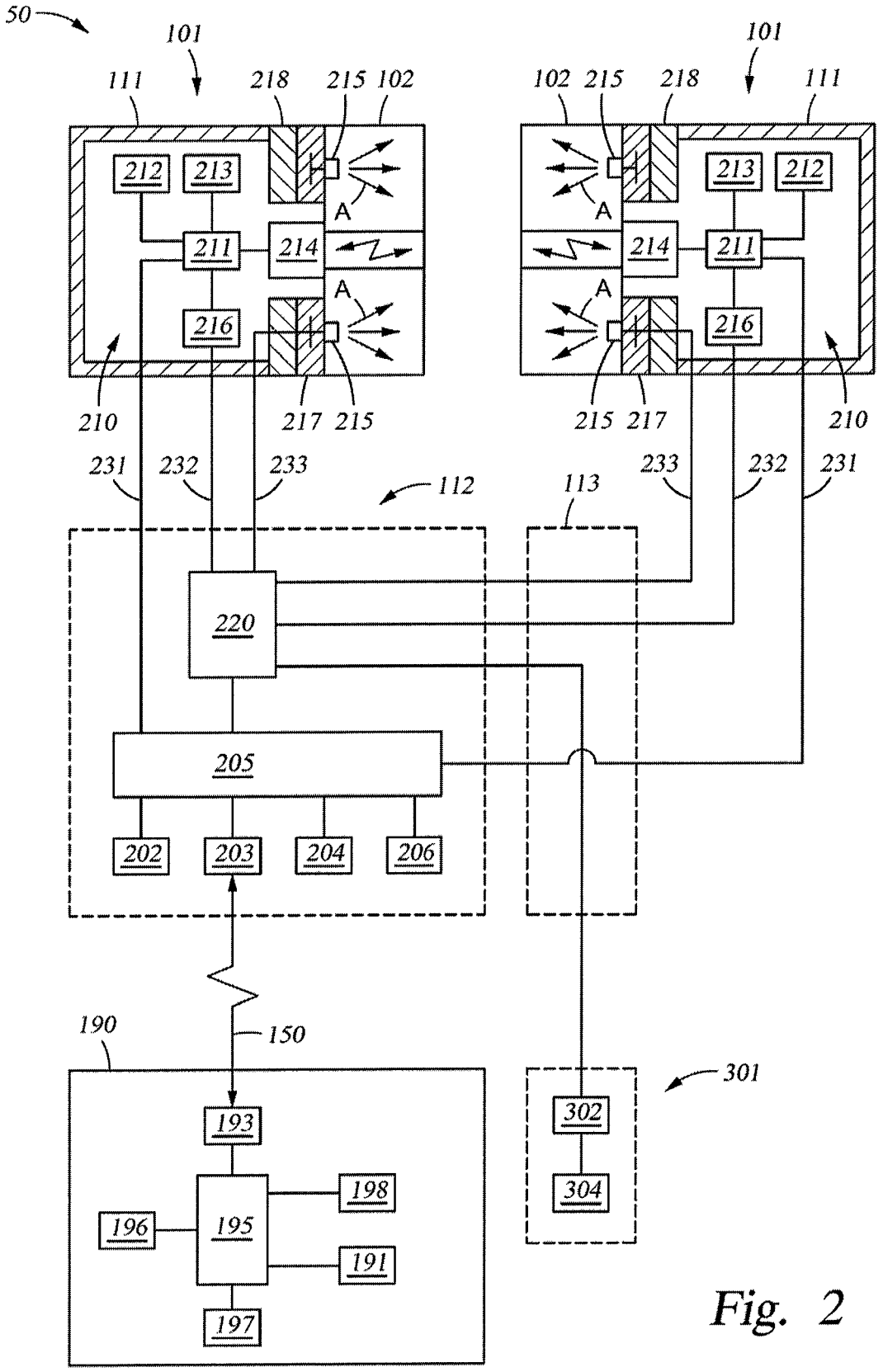
FIG. 2 is a block diagram of the audio device customization system shown in FIG. 1A, according to one embodiment.

FIG. 2 is a schematic view of the audio device customization system 50 that includes a block diagram of the audio device customization system 50 shown in FIG. 1A, according to one embodiment. FIG. 2 also includes additional components in the audio device customization system 50 that are not shown in FIG. 1A.

Each audio assembly 111 can include an earphone electronic assembly 210 that includes components to assist in providing audio to the user through the corresponding attached customizable ear insert 102. For example, each earphone electronic assembly 210 can include a memory 212, a processor 211 coupled to the memory 212, and a portable power source 216 (e.g., a battery) to power the components in the earphone electronic assembly 210. The memory 212 can include data (e.g., audio data) and one or more applications stored therein. The processor 211 may be any hardware unit or combination of hardware units capable of executing software applications and processing data, including, e.g., audio data. For example, processor 211 could be a central processing unit (CPU), a digital signal processor (DSP), an application-specific integrated circuit (ASIC), a combination of such units, and so forth. The processor 211 is configured to execute software applications, process audio data, and communicate with I/O devices among other operations.

The memory 212 may be any technically feasible type of hardware unit configured to store data. For example, memory 212 could be a hard disk, a random access memory (RAM) module, a flash memory unit, or a combination of different hardware units configured to store data. Software application(s) within memory 212 can include program code (e.g., instructions) that may be executed by processor 211 in order to perform various functionalities associated with the audio device, such as playing or adjusting audio output and/or activating the radiation source for curing the filler in the customizable ear insert 102 for a desired period of time.

The earphone electronic assembly 210 can further include I/O devices 213, such as a microphone assembly or a sensor (e.g., a pressure sensor), and an audio driver 214. The microphone assembly can be used to adjust the audio provided to the user based on feedback received at the microphone assembly, such as lowering the volume provided to the user when the user is speaking. For example, in one embodiment, the microphone assembly can include multiple microphones, such as a first microphone configured to receive a first audible signal from an external source (i.e., external to the audio device 100) and a second microphone configured to receive a second audible signal that is being provided to the user through the sound tube, thus enabling the audio device 100 to determine the relative difference between the two audible signals and then allow the audio device 100 to adjust the acoustic level of the second audible signal and/or improve the level of acoustic isolation experienced by the user. In one embodiment, the earphone electronic assembly 210 can include a plurality of pressure sensors at different locations within the earphone electronic assembly 210. The plurality of pressure sensors can be used to provide feedback to the user during the customization process to assist the user in applying a different pressure or a more uniform pressure at different portions of the earphone electronic assembly 210. Applying a more uniform pressure at different locations of the earphone electronic assembly 210 can help the user achieve a better result for customizing the ear inserts 102 to the user's ears. In some embodiments, one or more of the pressure sensors can alternatively be located within one of ear inserts 102, for example in the curable filler material disposed in the ear insert 102. The audio driver 214 is used to generate an audible output (e.g., one or more audio signals at frequencies >200 Hz) that is provided to the user of the audio device 100. Although only one audio driver 214 is shown, in some embodiments, each earphone electronic assembly 210 may include two or more audio drivers that can be used to produce the high-quality audio output commonly associated with some types of audio devices, such as in-ear monitors. In some embodiments, the audio driver 214 can be a balanced armature driver such that an electric current is passed through a coil that is wrapped around an armature. In other embodiments, the audio driver 214 can be a dynamic driver such that a diaphragm is attached directly to a voice coil that moves between one or more magnets.

The I/O devices 213 and the audio driver 214 can also be coupled to the processor 211 and to the memory 212. In some embodiments, each earphone electronic assembly 210 can include additional I/O devices (not shown) capable of receiving various inputs and/or providing various desirable outputs. These additional I/O devices may include one or more outputs (e.g., control relays) for controlling other outputs (e.g., radiation source 215 described below) of the earphone assembly 101. These I/O devices can also include one or more signal processing support components, signal filtering components (e.g., low pass and/or high pass filters) and components used to enable the delivery of an audible output from the audio driver 214 (e.g., signal amplifiers).

Each audio assembly 111 is attached to a corresponding customizable ear insert 102. In one embodiment, each customizable ear insert 102 includes a plurality of radiation sources 215. In some embodiments, the plurality of radiation sources can be embedded in the curable filler material disposed in the customizable ear insert 102. In other embodiments, one or more radiation sources 215 are disposed within the housing of the audio assembly 111 and adjacent to a surface of the customizable ear insert 102, as discussed further below in conjunction with FIGS. 15A-15C. In some embodiments, each radiation source 215 can be a source of electromagnetic radiation, such as a light source that emits wavelengths in the visible wavelength range and/or ultraviolet (UV) wavelengths. In some embodiments, each radiation source 215 is configured to emit light at one or more wavelength below the infrared range (e.g., <750 nm). For example, in one embodiment, the radiation source 215 includes a light emitting diode (LED) that emits radiation at a wavelength from about 345 nm to about 420 nm, such as about 405 nm can be used to cure the filler disposed in the customizable ear insert 102. Although the embodiments described in this disclosure are described as including a plurality of radiation sources 215, in some embodiments, a single radiation source (e.g., a single LED) can also be used. Furthermore, in some embodiments, a radiation source disposed outside of the audio device 100 can also or alternately be used to supply energy into the customizable ear insert 102, such as a LED that can emit energy into the customizable ear insert 102 through a transparent portion of the exterior of the customizable ear insert 102.

Figure 4:
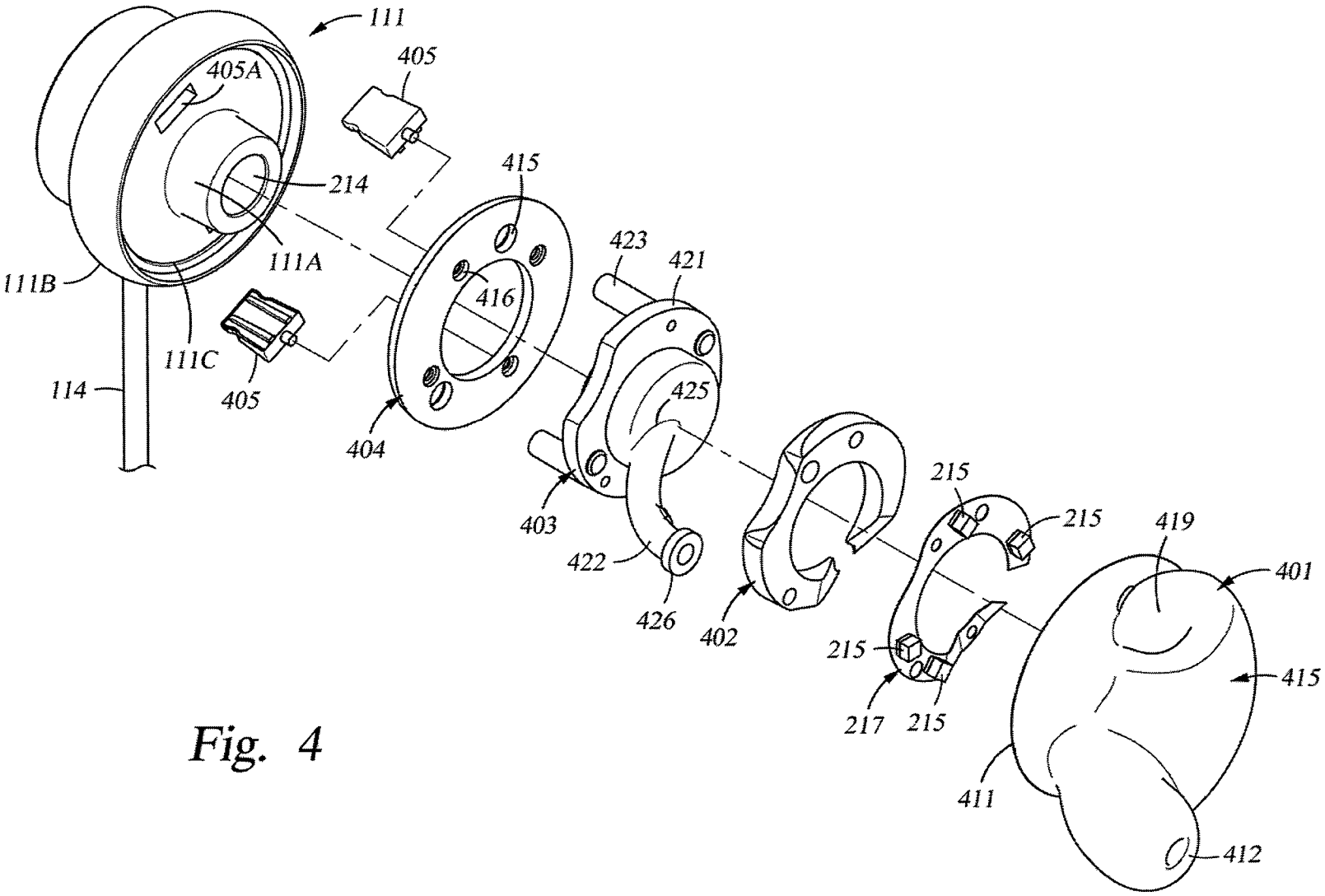
FIG. 4 is a perspective view of one of the earphone assemblies of the audio device including an exploded view of the customizable ear insert, according to one embodiment.

Each customizable ear insert 102 can further include a flexible printed circuit board (PCB) 217 and one or more supporting elements (see support spacer 402 in FIG. 4). The plurality of radiation sources 215 can be placed on the flexible PCB 217. In some embodiments, the flexible PCB 217 and radiation sources 215 can be disposed in the curable filler material of the customizable ear insert 102, so that at least one surface of the flexible PCB contacts the curable filler material. The one or more supporting elements can be used for purposes, such as supporting the flexible PCB 217 in a proper location within the customizable ear insert 102 to enable the energy from the radiation sources 215 to efficiently and effectively cure the curable filler material disposed in the customizable ear insert 102. It is believed that positioning the radiation sources 215 within the curable filler material will improve the ability of the radiation sources 215 to efficiently and effectively cure the curable filler material disposed in the customizable ear insert 102 due to the reduced amount of reflections that would be created if an air-gap existed between the casing of the radiation source 215 and the curable filler material due to the change in the refractive index found at the air-gap/radiation source casing interface and air-gap/curable filler material interface.

The audio device 100 further includes the controller assembly 112, which is coupled to each earphone assembly 101 through the one or more cables 114 (see FIG. 1A). The controller assembly 112 can include a memory 202, a processor 205 coupled to the memory 202, one or more I/O buttons to receive user input (e.g., volume button, command button, power button) and a portable power source 206 (e.g., a battery) to power the components in the controller assembly 112. The memory 202 can include data (e.g., audio data) and one or more applications stored therein. The processor 205 may be any hardware unit or combination of hardware units capable of executing software applications and processing data, including, e.g., audio data. For example, processor 205 could be a central processing unit (CPU), a digital signal processor (DSP), an application-specific integrated circuit (ASIC), a combination of such units, and so forth. The processor 205 is configured to execute software applications, process audio data, communicate with I/O devices, and communicate with the earphone electronic assemblies 210 in the respective earphone assemblies 101 among other operations. For example, the processor 205 of the controller assembly 112 can be configured to communicate with the processor 211 in each of the respective earphone electronic assemblies 210 through a data link 231 (e.g., a wired communication link). The data link 231 can be used to control operation of the audio device 100 including in some embodiments, controlling the operation of the curing process used to customize the customizable ear inserts 102.

The memory 202 may be any technically feasible type of hardware unit configured to store data. For example, memory 202 could be a hard disk, a random access memory (RAM) module, a flash memory unit, or a combination of different hardware units configured to store data. Software application(s) within memory 202 can include program code that may be executed by processor 205 in order to perform various functionalities associated with the audio device 100, such as playing or adjusting audio output and activating the radiation source 215 for curing the curable filler material disposed in the customizable ear insert 102 as well as communicating with external devices, such as the external electronic device 190 shown in FIG. 1A.

In an effort to avoid redundancy, in some embodiments of the audio device 100, the memory 202 and processor 205 may be the only processing components within the audio device 100, and thus multiple discrete processors and memory are not found within the audio device 100. In one configuration, any activities or processes that would have been performed by the processor(s) 211 and memory 212, if present in the audio assemblies 111, are performed by the use of the memory 202 and processor 205 of the controller assembly 112.

The controller assembly 112 can further include a transceiver 203 and I/O devices 204. In some embodiments, the transceiver 203 can be a wireless transceiver. The transceiver 203 can be configured to establish one or more different types of wireless communication links with other transceivers residing within other electronic devices, such as the external electronic device 190. For example, the transceiver 203 could establish a Wi-Fi communication link, a Bluetooth® communication link, or a near field communication (NFC) link, among other types of communication links with other electronic devices, such as the external electronic device 190. I/O devices 204 may include inputs (e.g., a 3.5 mm audio input jack) to receive audio input from an external wired audio source (not shown). I/O devices 204 may also include outputs and other inputs, such as one or more status indicators (e.g., LEDs) as well as buttons or switches to control and/or monitor the operation of the audio device 100 including starting and stopping audio playback as well as assisting in controlling and/or monitoring the curing process of the curable filler material disposed in the customizable ear insert 102.

The controller assembly 112 can further include a power controller 220. The power controller 220 can be used to control the supply of power from an external power source to the radiation sources 215 of the customizable ear insert 102 during the curing process. For example, the power controller 220 can be electrically coupled to an external power supply 301 through the connection assembly 113. The power controller 220 can be coupled to the radiation sources 215 through a power link 233 (e.g., a wired connection). The power controller 220 can be used to control the voltage and/or amperage supplied to the radiation sources 215 through the power link 233 during the curing process. In some embodiments, the power controller 220 can also be used to recharge the portable power sources 216 in the respective earphone assemblies 101 by use of the source power link 232. Furthermore, in some embodiments, a power controller can be located in each earphone assembly 101 instead of in the controller assembly 112.

The external power supply 301, introduced above, can be connected to the audio device 100. The external power supply 301 can include a portable power source 304 (e.g., a battery) and a power source connector 302. The portable power source 304 can generally supply substantially more power (e.g., Amp-hours) than the power sources within the audio device 100, such as the other portable power sources 206, 216 described above. The term portable power source as used herein generally describes a power source that is easily moveable and is able to provide power to electronic components in the audio device when the portable power source is not connected to a fixed power source, such as a wall electrical outlet or plug. The portable power source 304 can be used to supply the power to the radiation sources 215 during the curing process. The power source connector 302 can electrically couple the external power supply 301 to the connection assembly 113 (see also FIG. 1A) of the audio device 100. The external power supply 301 can further include other connectors (not shown) for supplying external power to the portable power source 304, such as a USB connector for charging the portable power source 304 through an electronic device or a wall-mounted power supply that accepts a USB connector. In some embodiments, the external power supply 301 can include a wired power supply instead of the portable power source 304 described above.

The audio device 100 may communicate to the external electronic device 190 during use of the audio device 100 by the user. For example, the external electronic device 190 can be controlled by the user to control (e.g., initiate) and monitor the customization process performed on the audio device 100 to enable the earphones on the audio device 100 to be customized to the user's ear(s). The external electronic device 190 may also be used to stream audio content to the audio device 100 for listening by the user. The external electronic device 190 can communicate with the audio device 100 over the communication link 150, which can be a wireless communication link.

The external electronic device 190 can include a memory 196, a processor 195 coupled to the memory 196, and a power source 198 (e.g., a battery) to power the components in the external electronic device 190. The memory 196 can include data (e.g., audio data) and one or more applications stored therein. The memory 196 may be any technically feasible type of hardware unit configured to store data. For example, memory 196 could be a hard disk, a random access memory (RAM) module, a flash memory unit, or a combination of different hardware units configured to store data. Software application(s) within memory 196 can include program code that may be executed by processor 195 in order to perform various functionalities associated with the external electronic device 190, such as streaming audio content to the audio device 100 as well as providing a user interface for the user to control the customization of the ear inserts 102.

The processor 195 may be any hardware unit or combination of hardware units capable of executing software applications and processing data, including, e.g., audio data. For example, processor 195 could be a central processing unit (CPU), a digital signal processor (DSP), an application-specific integrated circuit (ASIC), a combination of such units, and so forth. The processor 195 is configured to execute software applications, process audio data, and communicate with I/O devices and to communicate to the controller assembly 112 of the audio device 100 among other operations.

The external electronic device 190 can further include a transceiver 193 for communicating with the controller assembly 112 of the audio device 100 through the communication link 150. The communication link 150 can also be used to stream audio content from the external electronic device 190 to the audio device 100 as well as for communication to the audio device 100 during the customizing of the ear inserts 102 to the user's ears. In some embodiments, the transceiver 193 can be a wireless transceiver. The transceiver 193 can be configured to establish one or more different types of wireless communication links with other transceivers residing within other electronic devices, such as the audio device 100. For example, the transceiver 193 could establish a Wi-Fi communication link, a Bluetooth® communication link, or a near field communication (NFC) link, among other types of communication links with other electronic devices, such as the audio device 100.

The external electronic device 190 can further include a speaker 197. The speaker 197 can be used for a number of operations including providing the user audio instructions and feedback before, during, and after the process for customizing the ear inserts 102 to the user's ears. The external electronic device 190 further includes the user interface introduced in FIG. 1A above. The user interface 191 can also be used to assist the user during the customization process as well as for assisting with streaming audio content to the audio device 100 from the external electronic device 190.

Figure 3:
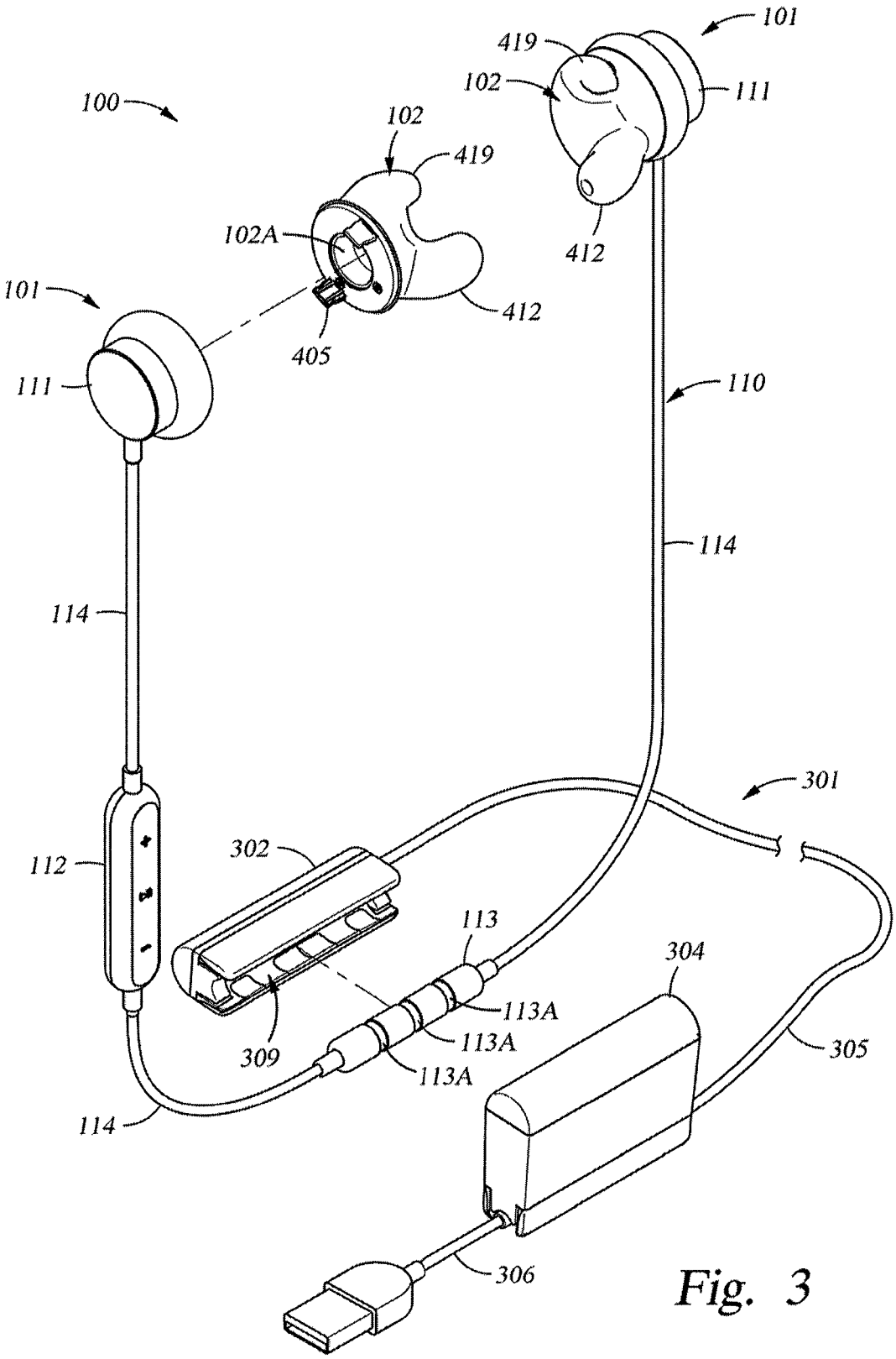
FIG. 3 is a perspective view of the audio device and the external power supply, according to one embodiment.

FIG. 3 is a perspective view of the audio device 100 and the external power supply 301, according to one embodiment. The customizable ear insert 102 is shown disconnected from the audio assembly 111 of the earphone assembly 101 on the left side of FIG. 3. In some embodiments, the user may have the option of selecting different customizable ear inserts 102. For example, different customizable ear inserts 102 can have different sizes and/or shapes that are each better suited to fit users of different ear anatomies. Furthermore, the user may have the option of selecting customizable ear inserts 102 based on style preferences (e.g., color) or comfort preferences (e.g., texture and hardness). Having the customizable ear insert 102 be detachable from the audio assembly 111 also allows the user to easily replace the customizable ear insert 102 for any reason without incurring a significant cost since the customizable ear insert 102 are typically substantially less expensive than the audio assembly 111. For example, users can switch between different styles and sizes of customizable ear inserts 102, easily replace a non-functioning or damaged customizable ear insert 102, and also allow other users to use the audio device 100 by simply attaching the customizable ear inserts 102 for use with different users.

The external power supply 301 is shown disconnected from the audio device 100 to illustrate different features of the external power supply 301 and the connection assembly 113 of the audio device 100. The external power supply 301 can include a first cable 305 for connecting the portable power source 304 to the power source connector 302. The external power supply 301 can further include a second cable 306 (e.g., a USB cable) for connecting the portable power source 304 to an external power source for charging the portable power source 304.

The connection assembly 113 can include a plurality of connection terminals 113A for connecting to corresponding terminals (not shown) of the power source connector 302. The power source connector 302 can include a channel 309 for receiving the connection assembly 113. In some embodiments, one or more of the power source connector 302 and the connection assembly 113 can include magnetic material that is configured to be attracted to magnetizable material in the other connector to assist with creating and maintaining the electrical connection between the power source connector 302 and the connection assembly 113.

Figure 5:
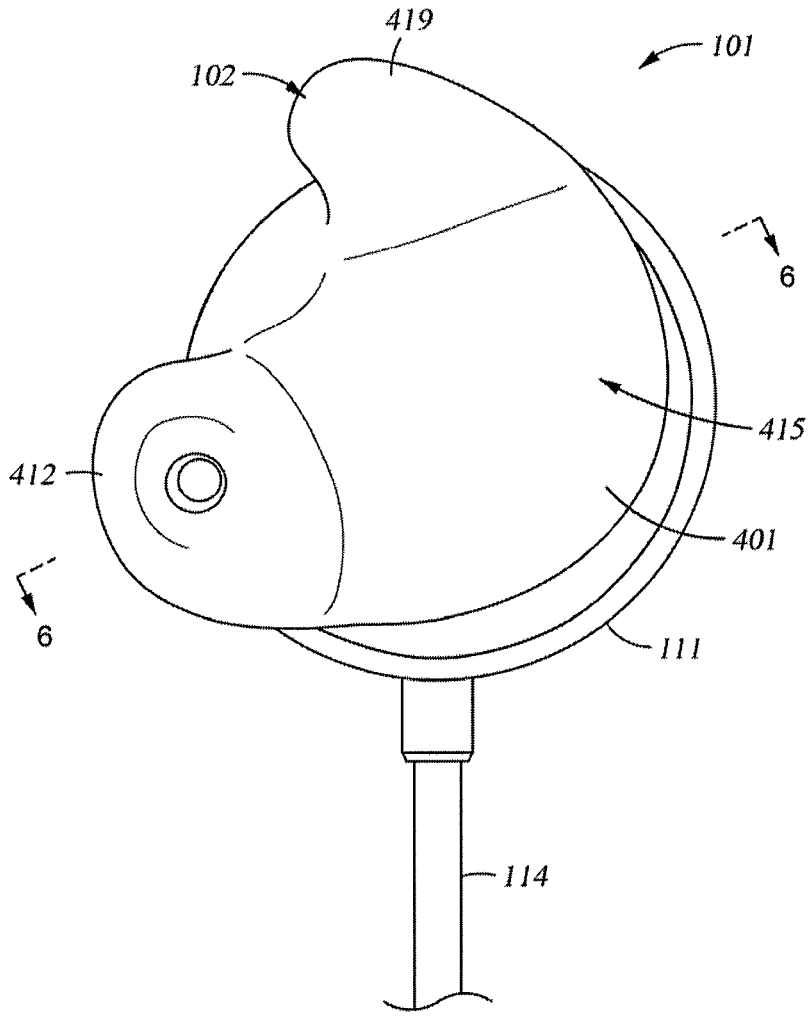
FIG. 5 is a perspective view of the earphone assembly, according to one embodiment.

FIG. 4 is an exploded view of one of the earphone assemblies 101 of the audio device 100, according to one embodiment. FIG. 5 is a plan view of the customizable ear insert 102, according to one embodiment. In FIG. 4, the audio assembly 111 is shown with the output of the audio driver 214 facing the customizable ear insert 102. In one embodiment, the customizable ear insert 102 includes connectors 405. The connectors 405 can be used to separably couple and electrically connect electrical components disposed within the customizable ear insert 102 to the audio assembly 111. The male connectors 405 can be inserted within the female connection points 405A shown in FIG. 4. For example, the connectors 405 can be used to provide an electrical connection to the radiation sources 215 that are used to cure the curable filler material disposed in the customizable ear insert 102. The connectors 405 enable the customizable ear insert 102 to be easily separably attached and removed from the audio assembly 111. However, in some embodiments, as discussed further below in conjunction with FIGS. 15A-15C the customizable ear insert 102 may only optionally include the connectors 405. As shown in FIGS. 3 and 4, the audio assembly 111 may include a protrusion 111A (FIG. 4) that is configured to be inserted with a mating recess 102A (FIG. 3) to allow the customizable ear insert 102 and the audio assembly 111 to be separably coupled, or separably attached, to each other, and thus can be attached, detached and reattached multiple times without significantly damaging or degrading the mating surfaces, interfacing materials or interfacing structural elements. In one embodiment, the outer diameter of the protrusion 111A may be sized such that it is slightly larger than the size of the recess 102A to provide a light interference fit between these features and thus allow the components to be separably coupled and also provide a seal between the audio assembly and the inlet end of the sound tube 422 to prevent unwanted sound leakage at the interface between the customizable ear insert 102 and the audio assembly 111. Use of the protrusion 111A and mating recess 102A as a coupling that is separable when desired by a user may be especially useful in configurations where the connectors 405 and female connection points 405A are not part of the customizable ear insert 102 and audio assembly 111, respectively. In some embodiments, the structure of the junction, which is formed between the components that form a separably coupled coupling, does not require any additional tools or materials (e.g., adhesives) for the junction to be formed and the junction to be unformed (i.e., parts to be attached or detached).

Figure 6:
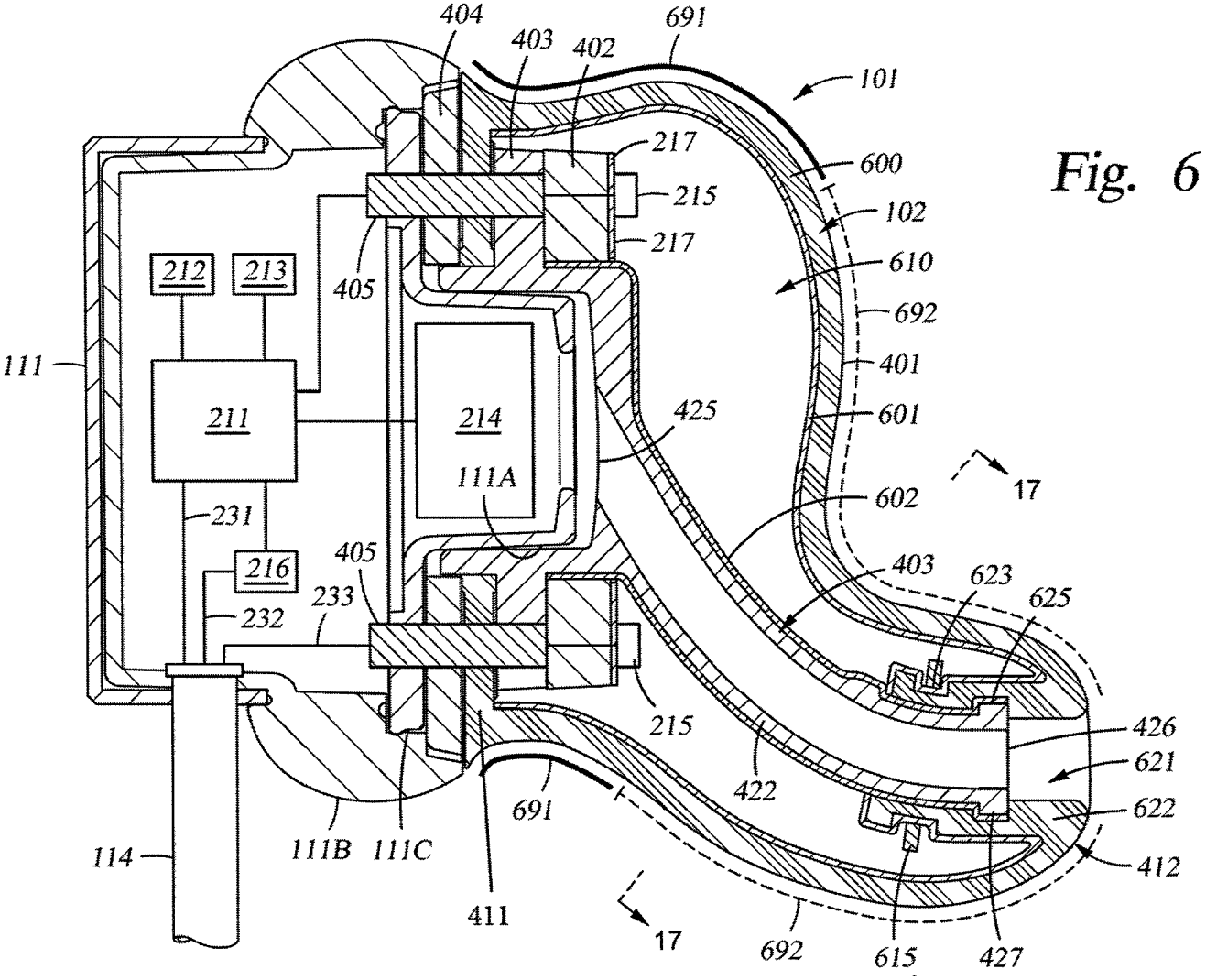
FIG. 6 is a cross-sectional view of the earphone assembly taken along section line 6-6 of FIG. 5, according to one embodiment.

The customizable ear insert 102 further includes a sleeve assembly 401. The sleeve assembly 401 forms an enclosure to house components within the customizable ear insert 102, such as the curable filler material, the flexible PCB 217 and the radiation sources 215. The sleeve assembly 401 can include a flexible and deformable material that can conform to the shape of the user's ear during curing process. The sleeve assembly 401 includes a collar 411 (FIG. 4) portion of the sleeve 600. The collar 411 can be used to retain components inside the sleeve assembly 401 as illustrated in FIG. 6 described below. The sleeve assembly 401 further includes an ear tip 412 that is used to provide audio to the user during use of the earphone assembly 101. The ear tip 412 can be placed in a user's ear canal during use of the audio device 100.

The sleeve assembly 401 can include a "sleeve body" that includes a sleeve 600 (see FIG. 6) that contacts the user's ear, and as discussed further below may optionally include an interior coating 601. The sleeve 600 can be formed of a biocompatible material that can conform to the individual shape of a user's ear while maintaining sufficient tear and puncture resistance and serving as a barrier to prevent the curable filler material from contacting the user. Sufficient bonding between the inner surface of the sleeve body (i.e., inner surface of the sleeve 600 or interior coating 601) and the curable filler material can also help prevent tearing of the sleeve 600 when a force is applied to the sleeve assembly 401 by a user. The sleeve 600 can be formed from a flexible material, such as an elastic material that has a tendency to return to its original shape after a force had been applied to and removed from the elastic material. Materials that are suitable to form the sleeve 600 include silicone, fluorosilicone, nitrile, acrylate, high consistency rubber (HCR), and thermoplastic elastomers (e.g., thermoplastic polyurethane (TPU), such as aliphatic TPU).

The sleeve 600 (see FIG. 6) can be formed using various molding processes, such as compression molding, injection molding, and dip molding. The sleeve assembly 401 can have a thickness from about 0.5 mm to about 1.2 mm, such as from about 0.7 mm to about 1.0 mm, such as about 0.75 mm. The sleeve assembly 401 can have a hardness from about 25 Shore A to about 45 Shore A, such as from about 30 Shore A to about 40 Shore A. In some embodiments, as discussed further below, the sleeve 600 is formed such that it includes different thicknesses in different regions of the sleeve 600.

The customizable ear insert 102 further includes a sound tube assembly 403. The sound tube assembly 403 includes a sound tube 422. The sound tube 422 includes an input region 425 and an output region 426. The input region 425 is disposed at the input end of the sound tube 422 and adjacent to the opening formed in the protrusion 111A. The sound tube 422 is used to transfer the audio output provided from the audio driver 214 to the user. The audio output from the audio driver 214 is received at the input region 425 of the sound tube 422 and then transferred through the sound tube to the output region 426 of sound tube 422 and to the user through the ear tip 412 of the sleeve assembly 401.

The sound tube assembly 403 further includes a base 421. The base 421 of the sound tube assembly 403 can be used to retain the sound tube assembly 403 within the sleeve assembly 401. For example, the base 421 of the sound tube assembly 403 can contact and be supported by the interior of the collar 411 of the sleeve assembly 401 as shown in FIG. 6 below. The sound tube assembly 403 further includes a plurality of tubes 423. In some embodiments, the plurality of tubes 423 can be used to add the curable filler material to the interior of the sleeve assembly 401 after positioning the sound tube assembly 403 in the sleeve assembly 401. The sound tube 422 and other portions of the sound tube assembly 403, such as the base 421 and the tubes 423, can be formed of a thermoplastic elastomer (e.g., a thermoplastic polyurethane (TPU), silicone, polycarbonate, acrylonitrile butadiene styrene, or polypropylene). In one embodiment, the sound tube 422 and other portions of the sound tube assembly 403 are formed of an opaque white TPU material that can provide diffuse reflection of the light from the radiation sources 215, which can assist in the curable filler material achieving a full cure. In some embodiments, the sound tube assembly 403 can further include fasteners for connecting other components to the sound tube assembly 403, such as flexible PCB 217 and the support 404 described below. The sound tube 422 and other portions of the sound tube assembly 403 can have a hardness from about 60 Shore A to about 120 Shore A, such as about 90 Shore A.

The customizable ear insert 102 further includes a support 404 disposed between the collar 411 of the sleeve assembly 401 and the audio assembly 111. The support 404 can be formed from a more rigid material than the sleeve assembly 401 to provide structural support for the customizable ear insert 102. The base 421 of the sound tube assembly 403 can also be connected to the support 404. For example, in one embodiment the support 404 is connected to the base 421 (FIG. 4) of the sound tube assembly 403 using fasteners.

The flexible PCB 217 can be positioned between the base 421 of the sound tube assembly 403 and the output region 426 of the sound tube assembly 403. In some embodiments, the flexible PCB 217 can have a shape of a ring or a partial ring, so that the flexible PCB 217 at least partially surrounds the sound tube 422. A plurality of radiation sources 215, such as LED's, can be disposed on the flexible PCB 217. Having the plurality of radiation sources 215 disposed on the flexible PCB 217 (i.e., opposed to a non-flexible PCB) that is disposed around the sound tube 422 can help prevent the user from feeling the presence of the PCB during use of the audio device 100 while also reducing the likelihood that a rigid portion of a non-flexible PCB could puncture the sleeve assembly 401. The flexible PCB 217 can further include a larger than normal copper ground plane to serve as a heat sink to remove the heat generated by the radiation sources 215 during the customization process and deliver it to the thermally conductive components in the audio assembly. In some embodiments, a current from about 50 mA to about 150 mA, such as about 100 mA, can be provided to the radiation sources 215 during the customization process. In some embodiments, the flexible PCB 217 or the power controller 220 (see FIG. 2) can step-up the voltage provided from the external power supply 301 in order to lower the amperage and reduce the heat generated by the radiation sources 215 during the customization process. For example, in one embodiment, power at a voltage of about 3V from the external power supply 301 can be increased to a level of about 15V which is provided to the radiation sources 215. In one embodiment, the power controller 220 is configured to provide a fixed maximum current to the radiation sources 215 during the customization process to prevent the curable filler material from reaching a temperature that is uncomfortable for the user.

The plurality of radiation sources 215 can be spaced apart from each other around the flexible PCB 217 to reduce a furthest distance between the radiation sources 215 and portions of the curable filler material disposed in the sleeve assembly 401, such as portions of the curable filler material disposed in the ear tip 412 of the sleeve assembly 401. In one embodiment, each radiation source 215 can have a particularly small footprint inside the sleeve assembly 401, such as about 1.6 mm by about 1.6 mm. In some embodiments, a support spacer 402 can be positioned between the base 421 of the sound tube assembly 403 and the flexible PCB 217 to allow further precision for positioning the radiation sources 215 inside the sleeve assembly 401. In some embodiments, the flexible PCB 217 can be connected to the sound tube assembly 403, for example, by using fasteners that connect to the base 421 of the sound tube assembly 403.

FIG. 5 is a perspective view of the earphone assembly 101, according to one embodiment. In FIG. 5, a section line 6-6 extends from the ear tip 412 of the sleeve assembly 401 and through the customizable ear insert 102 and the audio assembly 111.

FIG. 6 is a cross-sectional view of the earphone assembly 101 taken along section line 6-6 of FIG. 5, according to one embodiment. FIG. 6 illustrates one embodiment that shows how the different components in the customizable ear insert 102 and the audio assembly 111 fit together inside the earphone assembly 101.

In some embodiments, the sleeve body of the sleeve assembly 401 includes a sleeve 600 and an interior coating 601. In one configuration, the sleeve 600 can be formed from materials, such as silicone, fluorosilicone, nitrile, acrylate, high consistency rubber (HCR), and thermoplastic elastomers (e.g., thermoplastic polyurethane (TPU), such as aliphatic TPU). The interior coating 601 can have a thickness from about 50 μm to about 200 μm, such as about 100 μm. In one embodiment, the interior coating 601 can be formed from a silicone material that includes a reflective material, such as titanium dioxide, silver, or aluminum oxide. In one example, the interior coating 601 includes titanium dioxide having a grain size from about 100 nm to about 200 nm, such as about 150 nm. In some embodiments, the interior coating 601 can be evaporated onto, painted onto, sputtered onto, printed onto or sprayed onto the sleeve 600. The interior coating 601 can be used to form a barrier and/or reflective surface that reflects the energy emitted from the radiation sources 215. For example, in one embodiment, the radiation sources 215 emit radiation at a wavelength of about 405 nm, and the interior coating 601 is configured to reflect substantially all radiation having a wavelength of 405 nm, such as a material having a reflectance greater than 95% for radiation having a wavelength of 405 nm, such as a material having a reflectance greater than 99% for radiation having a wavelength of 405 nm.

Although the sleeve body of the sleeve assembly 401 is largely described herein as including a reflective interior coating, in some embodiments, the material used to form the sleeve 600 can be reflective, such as a polymer embedded with a reflective material, such as a silicone sleeve having titanium dioxide embedded in the silicone. In some embodiments, the sleeve body includes a sleeve 600 that contains a reflective material within it, and also does not include an interior coating 601. However, in embodiments in which the material used to form the sleeve 600 is reflective to the radiation from the radiation sources 215, an interior coating 601 may still be included within the sleeve body. In such embodiments, the interior coating can serve as a barrier to prevent migration of the curable filler material into or through the sleeve 600 while also being transparent to the radiation from the radiation sources 215, so that the radiation can be reflected by the material found within the sleeve 600.

The sound tube assembly 403 is disposed inside the sleeve assembly 401 and includes the sound tube 422. The sound tube 422 extends from the input region 425 of the sound tube 422 to the output region 426 of the sound tube 422 to transmit sound received from the audio driver 214 at the input region 425 to the user through the output region 426 of the sound tube 422. An inner volume 610 is located in the empty space between the sleeve assembly 401 and the components inside the sleeve assembly 401, such as the sound tube assembly 403. The curable filler material, which is used for customizing the ear insert 102 to the user's ear, can be added to the inner volume 610 during the manufacturing process.

The sleeve assembly 401 can further include an inward protrusion 622 formed over the sound tube 422 at the output region 426 of the sound tube 422. The inward protrusion 622 can surround a portion of the length of the sound tube 422 without blocking the output region 426 of the sound tube 422. The customizable ear insert 102 can further include a clasp 615 to assist in holding the inward protrusion 622 to the sound tube 422. The inward protrusion 622 can include a notch 623 for receiving the clasp 615. The notch 623 can help prevent the clasp 615 from moving after securing the inward protrusion 622 to the sound tube 422. In one embodiment, the clasp 615 can be an elastic ring. In other embodiments, the clasp 615 can be omitted, and the sound tube 422 at the output region 426 can be secured to a portion of the sleeve assembly 401 (i.e., a portion that is the same or similar to the inward protrusion 622) by welding or other methods.

The sound tube assembly 403 can further include an outer coating 602. The outer coating 602 can form a reflective surface that reflects the energy emitted from the radiation sources 215. In one embodiment, the outer coating 602 of the sound tube assembly 403 can be formed from the same material as the interior coating 601 of the sleeve assembly 401, such as silicone having a reflective material (e.g., titanium dioxide) embedded in the silicone. Furthermore, in some embodiments, all surfaces inside the sleeve assembly 401 that can be exposed to the radiation from the radiation sources 215 can be coated with the reflective material which is configured to reflect the energy emitted from the radiation sources 215, such as the same material used for the interior coating 601 of the sleeve assembly 401. In other embodiments, the sound tube 422 and other components inside the sleeve assembly 401 can be formed of a reflective material, such as a polymer that is loaded with an amount of a reflective material, such as a silicone material having titanium dioxide embedded in the silicone.

The support spacer 402 is disposed over the base 421 of the sound tube assembly 403. The flexible PCB 217 is disposed over the support spacer 402. The plurality of radiation sources 215 are disposed on the flexible PCB 217. As noted above, in some embodiments, the connectors 405 are used to attach the customizable ear insert 102 to the audio assembly 111. The connectors 405 can be attached to a component of the customizable ear insert 102 during manufacturing, such as being fastened to the support 404. A portion of each connector 405 can extend into or completely through the support 404 as part of providing an electrical connection to the radiation sources 215. The connectors 405 can receive electrical power from the power link 233 when the customizable ear insert 102 is connected to the audio assembly 111. The power link 233 can receive electrical power from the external power supply 301 as shown in FIG. 2 enabling the audio device 100 to remain lightweight and portable since the power source for energizing the radiation sources 215 comes from an external source that is not part of the audio device 100.

The audio assembly 111 also includes a housing that includes an outer housing 111B and a lid 111C. In some embodiments of the housing, the lid 111C includes the protrusion 111A that has an opening that allows sound provided from the one or more audio drivers 214 to be injected into the input region 425 of the sound tube 422. The outer housing 111B and lid 111C are configured to support and enclose the components found within the earphone electronic assembly 210 discussed above, which will include components that at least assist in providing audio to the user through the corresponding attached customizable ear insert 102 (e.g., audio driver 214).

Figure 7:
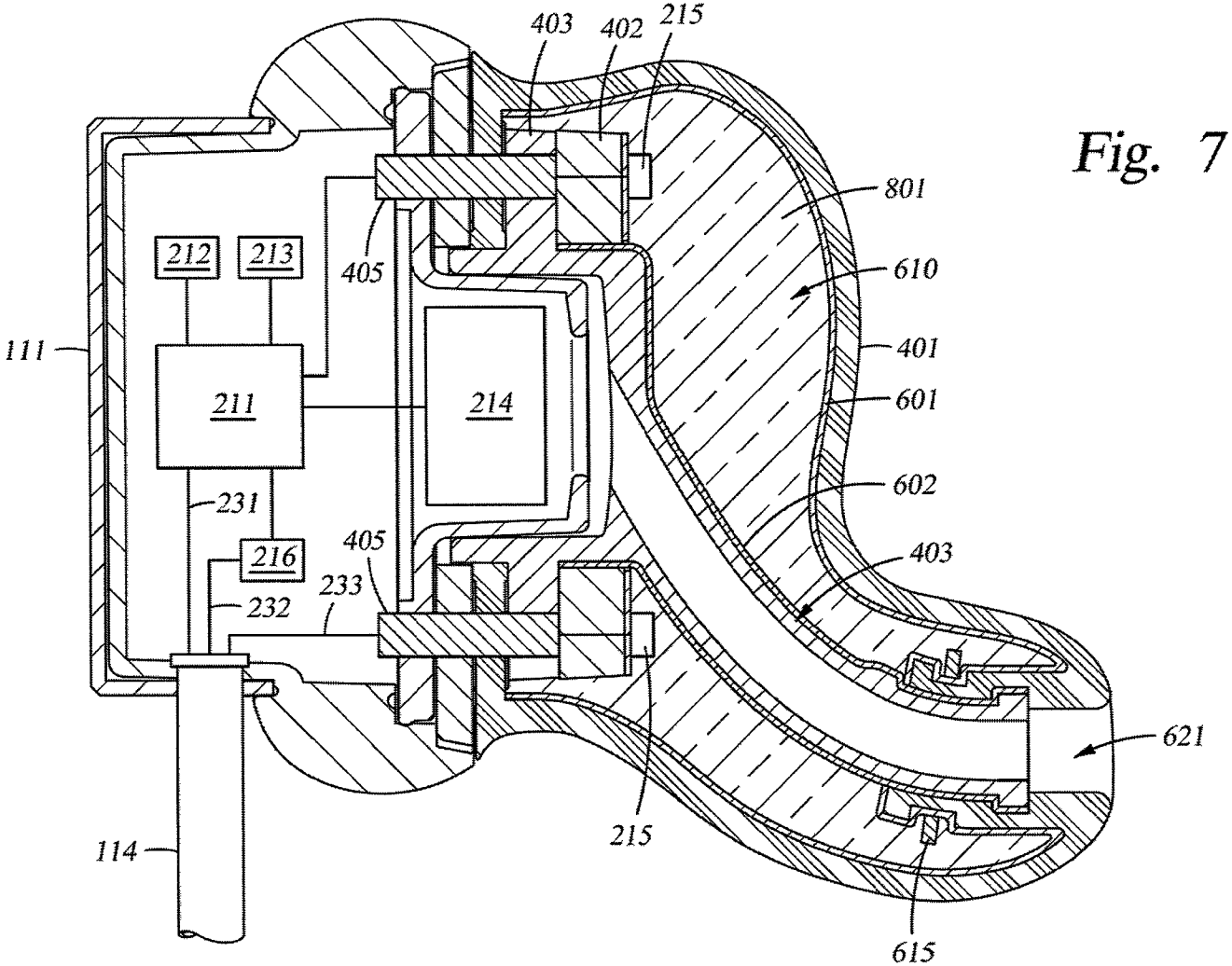
FIG. 7 illustrates a cross-sectional view of the customizable ear insert after a curable filler material has been added to the customizable ear insert, according to one embodiment.

FIG. 7 is a cross-sectional view of the customizable ear insert 102 after a curable filler material 801 has been added to the customizable ear insert 102, according to one embodiment. In some embodiments, the curable filler material 801 is a curable photopolymer (e.g., a urethane acrylate, silicone, or fluorosilicone) that is able to retain a desired fixed shape after performing a curing process while still maintaining an amount of flexibility after the curing process to accommodate movement in the ear canal and stresses placed on the curable filler material 801 during use of the audio device 100. For example, the curable filler material 801 can be cured by exposing it to electromagnetic radiation (e.g., visible light or UV light) provided from the radiation sources 215. In other embodiments, the curable filler material 801 may be another type of curable filler material, such as a chemically curable filler material (e.g., a reactive epoxy, urethane acrylate, or silicone).

The curable filler material 801 can be formed of a material that is biocompatible in both the uncured and cured state, so that potential contact with a user's skin does not irritate or harm the user. In embodiments, in which the curable filler material 801 is a photopolymer, the curable filler material 801 can include a concentration of photoinitiator to allow the curable filler material 801 to cure in about 30 seconds to about 120 seconds, such as curing in about 60 seconds. In some embodiments, the curable filler material 801 includes a polymer material, such as a silicone material. In some embodiments, the curable filler material 801 includes a fluoropolymer material, such as a fluorinated silicone material. In one embodiment, the curable filler material 801 includes fumed silica to enhance the mechanical properties of the curable filler material 801. The curable filler material 801 can have a viscosity before curing from about 15,000 cP to about 1,000,000 cP, such as from about 50,000 cP to about 120,000 cP, such as about 80,000 cP. In some embodiments, the curable filler material 801 can have a hardness after curing that is from about 20 Shore A scale to about 50 Shore A scale, such as about 30 Shore A after a curing process has been performed. In some embodiments, the curable filler material 801 can cure in about 30 seconds to about 120 seconds, such as in about 60 seconds. Furthermore, the curable filler material 801 and the sleeve assembly 401 can each remain flexible after curing, which also allows the combination of the curable filler material 801 and the sleeve assembly 401 to remain flexible. Typically, customized earpieces are rigid and non-flexible after customization is performed, which can present numerous problems for the user. For example, as a user ages, gains or loses weight, small but still significant changes to the contours of the user's ears can occur. These small changes to the user's ears can cause users of typical rigid and non-flexible customized earpieces to experience a fit, comfort, and performance that deteriorates over time. On the other hand, in the present disclosure, by maintaining flexibility of the curable filler material 801 and the sleeve assembly 401, the user can enjoy a consistent fit, comfort, and performance during use the flexible customizable ear inserts 102 that can adjust to the small changes in the contours of the user's ears that can occur over time. Furthermore, having the customizable ear inserts 102 maintain flexibility after curing also prevents the ear inserts 102 from being abrasive or otherwise injuring or irritating users as the users insert and remove the ear inserts 102 from the user's ears.

In some embodiments, the curable filler material 801 is selected so that it bonds with the material used to form the interior coating 601, and/or material used to form the sleeve 600, to prevent relative motion between the sleeve assembly 401 and the cured curable filler material 801 during normal use by a user. Relative motion between the sleeve assembly 401 and the cured curable filler material 801 can lead to the material in the sleeve assembly 401 "bunching-up" in certain regions of the customizable ear insert 102 when a load is applied to the customizable ear insert 102 during its insertion into the user's ear or other normal use, which can make the customizable ear insert 102 uncomfortable for the user to wear. The bond formed between the curable filler material 801 and the interior coating 601, and/or material used to form the sleeve 600 of the sleeve body, can be desirably controlled by the selection of compatible materials that will allow molecular scale mixing, chain entanglement and/or chemical bonding at the interface between cured curable filler material 801 and the interior coating 601 and/or material used to form the sleeve 600. In one example, the curable filler material 801 and the interior coating 601, and/or material used to form the sleeve 600, each include a silicone material. Another consideration when selecting the curable filler material 801 and materials for the sleeve assembly 401 is preventing migration of the curable filler material 801 through the sleeve body of the sleeve assembly 401 in an uncured state. It has been found that selecting compatible yet still flexible materials for the sleeve assembly 401 and curable filler material 801 is important to prevent migration of uncured or cured filler material 801 into or through the sleeve assembly 401. The materials for the curable filler material 801 and the sleeve assembly 401 can be selected to ensure a shelf life of at least six months. In some embodiments, the customizable ear inserts 102 can be vacuum sealed for packaging, placed inside an opaque package, and/or maintained in a controlled environment prior to customer use to enhance the shelf life of the customizable ear inserts 102. In some embodiments, including fluorosilicone in the sleeve assembly 401, such as part of the sleeve 600 or the interior coating 601, can prevent migration of the curable filler materials 801 described above.

Figure 8:
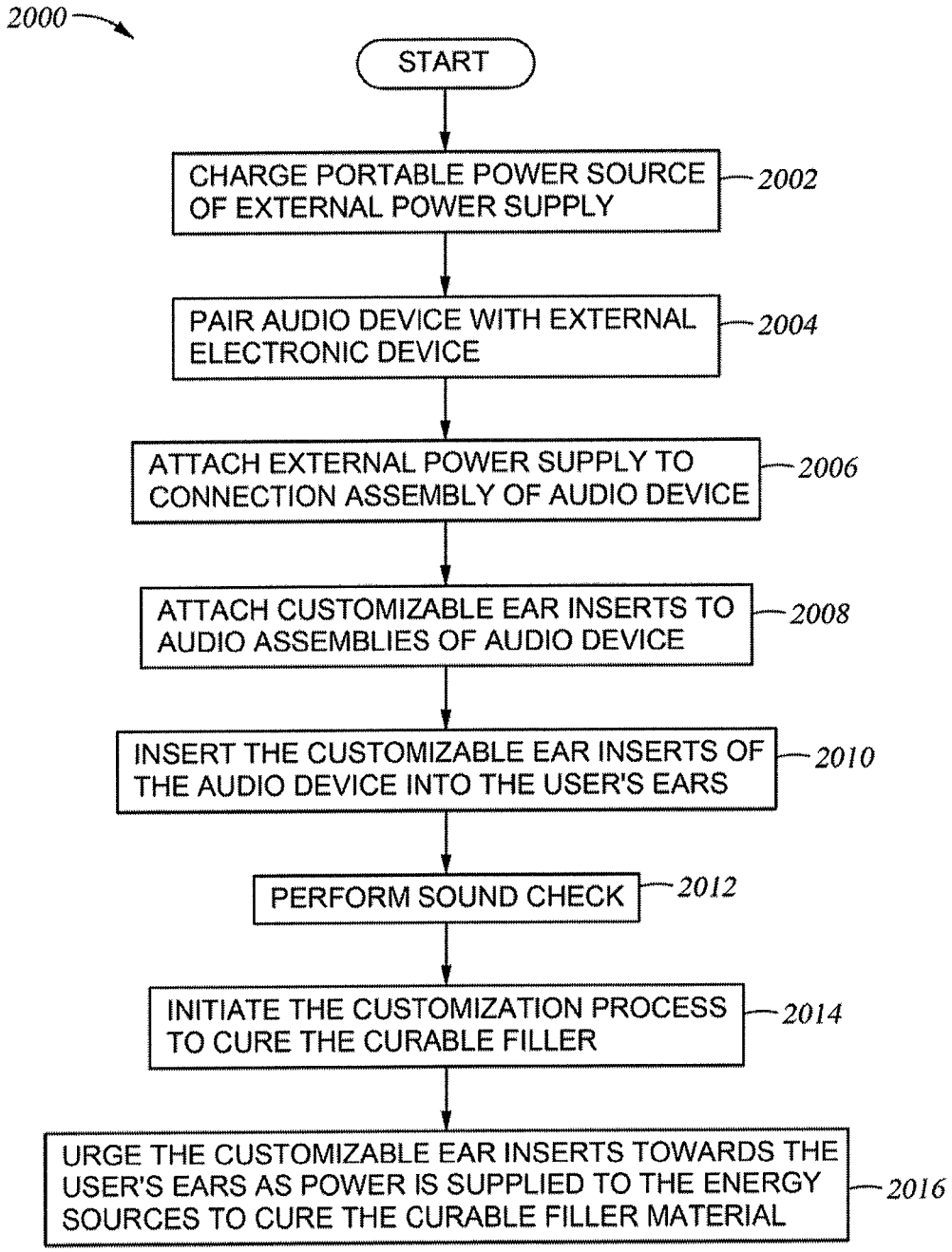
FIG. 8 is a process flow diagram of a method for customizing the audio device to a user's ears, according to one embodiment.

FIG. 8 is a process flow diagram of a method 2000 for customizing the audio device 100 to a user's ears, according to one embodiment. Although the method steps are described in conjunction with the systems and components shown in FIGS. 1-7, persons skilled in the art will understand that any system configured to perform the method steps, in any order, is within the scope of the present disclosure provided herein.

Referring to FIGS. 1-7, the method 2000 is described. At block 2002, the portable power source 304 of the external power supply 301 (see FIG. 3) is charged, so that sufficient power can be supplied to the radiation sources 215 in the customizable ear inserts 102 (see FIG. 6) during the curing process.

At block 2004, the audio device 100 can be paired (e.g., a Bluetooth® pairing process) with the external electronic device 190 (see FIG. 1A) enabling the user to control and monitor the curing process from the external electronic device.

At block 2006, the external power supply 301 can be attached to the connection assembly 113 of the audio device 100 (see FIG. 3). For example, the connection assembly 113 can be placed inside of the channel 309 of the power source connector 302.

At block 2008, the user can select and attach customizable ear inserts 102 to corresponding audio assemblies 111 (see FIG. 3). The user may select the customizable ear inserts 102 based on size, comfort, and style preferences. The user can attach the customizable ear inserts 102 to the corresponding audio assemblies 111 using the connectors 405 on the customizable ear inserts 102.

At block 2010, the user can insert the customizable ear inserts 102 of the audio device 100 into the user's ears. For example, the user can insert the ear tips 412 (see FIG. 4) of the customizable ear inserts 102 into the user's respective ear canals. At block 2010, the user should not apply any significant pressure when inserting the customizable ear inserts 102 into the user's ears. At block 2012, a sound check is performed to ensure that the external electronic device 190 is properly communicating with the audio device 100.

At block 2014, the user can press a start button in a software application running on the external electronic device 190 to initiate the customization process to cure the curable filler material 801 (see FIG. 7) disposed in the sleeve assembly 401 of the customizable ear inserts 102. The external electronic device 190 or the audio device 100 can delay the actual start of the curing process, for example by ten seconds, to allow the user time to reposition the user's hands to the audio device 100.

At block 2016, the user can press against the audio assemblies 111 urging the customizable ear inserts 102 towards the user's ears so that the curable filler material 801 and sleeve assembly 401 can deform and conform to the shape of the user's ears. Also, at block 2016, the actual curing process begins as power is supplied to the radiation sources 215 of the customizable ear inserts 102 (see FIG. 6) from the portable power source 304 of the external power supply 301 (see FIG. 3). The power can continue to be supplied to the radiation sources 215 for a designated time period, such as about 60 seconds, to allow the curable filler material 801 (see FIG. 7) to more fully cure.

During the processes performed at block 2016, the temperature of the curable filler material 801 may be monitored by use of a temperature sensing device (not shown) found in the I/O devices 213 found within the earphone electronic assembly 210. If the measured temperature is out of a desired range (i.e., too high or too low) a warning can be supplied to the user in the form of an audible signal or a prompt displayed on the external electronic device 190.

During the processes performed at block 2016, the pressure applied to the curable filler material 801 by the user may be monitored by use of a pressure sensing device (not shown) (e.g., strain gauge) found in the I/O devices 213 found within the earphone electronic assembly 210. If the measured pressure applied by the user is out of a desired range (i.e., too high or too low) a warning can be supplied to the user in the form of an audible signal or a prompt displayed on the external electronic device 190.

Figure 9A:
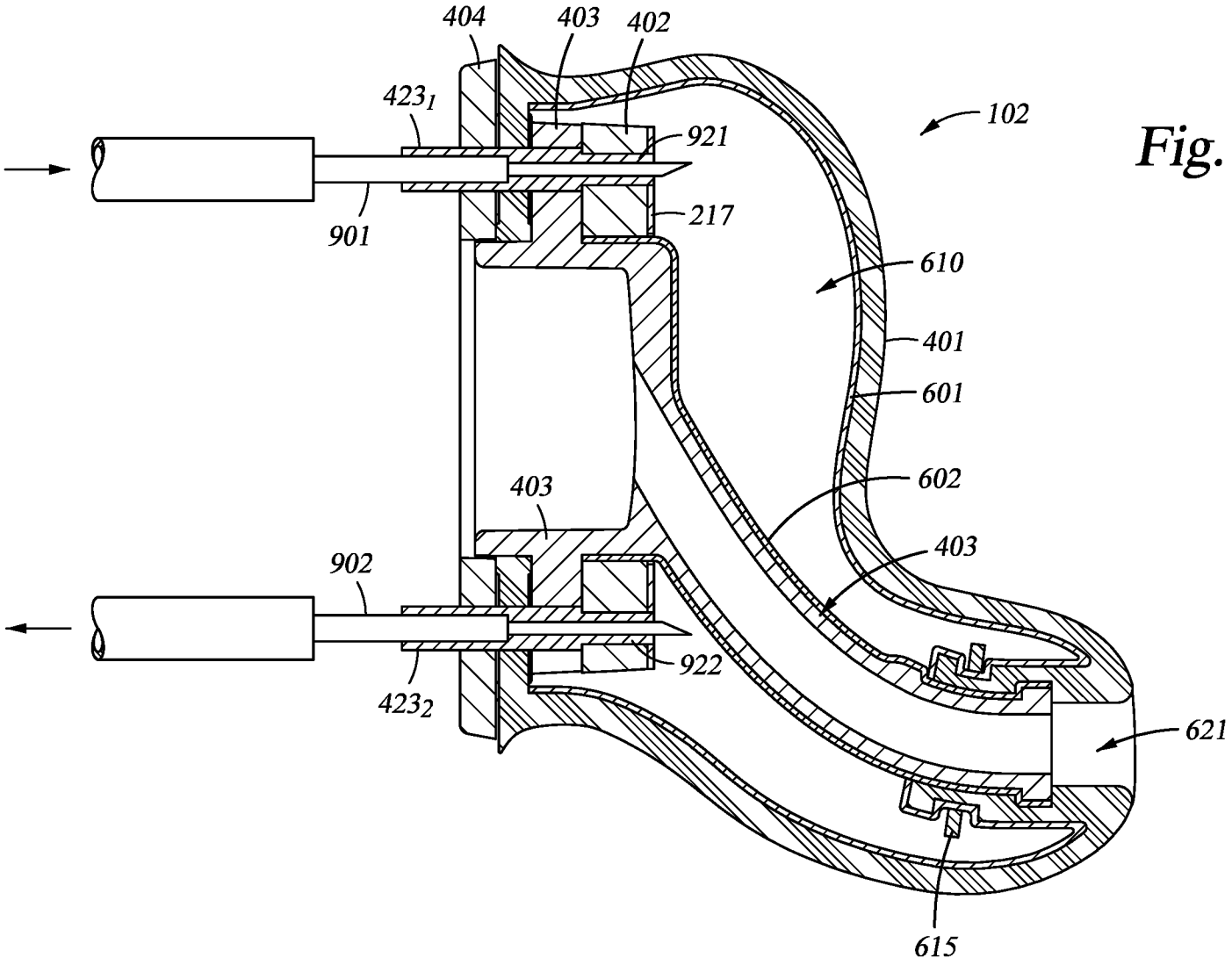
FIG. 9A illustrates a cross-sectional view of the customizable ear insert and some components for adding the curable filler material to the customizable ear insert, according to one embodiment.

FIG. 9A shows a cross-sectional view of the customizable ear insert 102 and some components for adding the curable filler material 801 to the customizable ear insert 102, according to one embodiment. For example, FIG. 9A shows a syringe 901 inserted into the inner volume 610 of the sleeve assembly 401. The syringe 901 can contain the curable filler material 801. The syringe 901 can be inserted through a first tube $\mathbf{423}_1$ of the sound tube assembly 403 and through a first hole 921 that extends through the support spacer 402 and the flexible PCB 217. A vacuum tube 902 can be connected to a second tube $\mathbf{423}_2$ of the sound tube assembly 403. A second hole 922 through the support spacer 402 and the flexible PCB 217 can connect the second tube $\mathbf{423}_2$ to the inner volume 610 of the sleeve assembly 401. The vacuum tube 902 can be connected to a vacuum pump (not shown) to provide suction to the inner volume 610 through the second tube $\mathbf{423}_2$ and the second hole 922. The suction can assist in distributing the curable filler material 801 throughout the inner volume 610 of the sleeve assembly 401. After adding the curable filler material 801 to the inner volume 610 of the sleeve assembly 401, the tubes 423 can be cut and sealed so that the curable filler material 801 is contained in the inner volume 610 of the sleeve assembly 401.

Figure 9B:
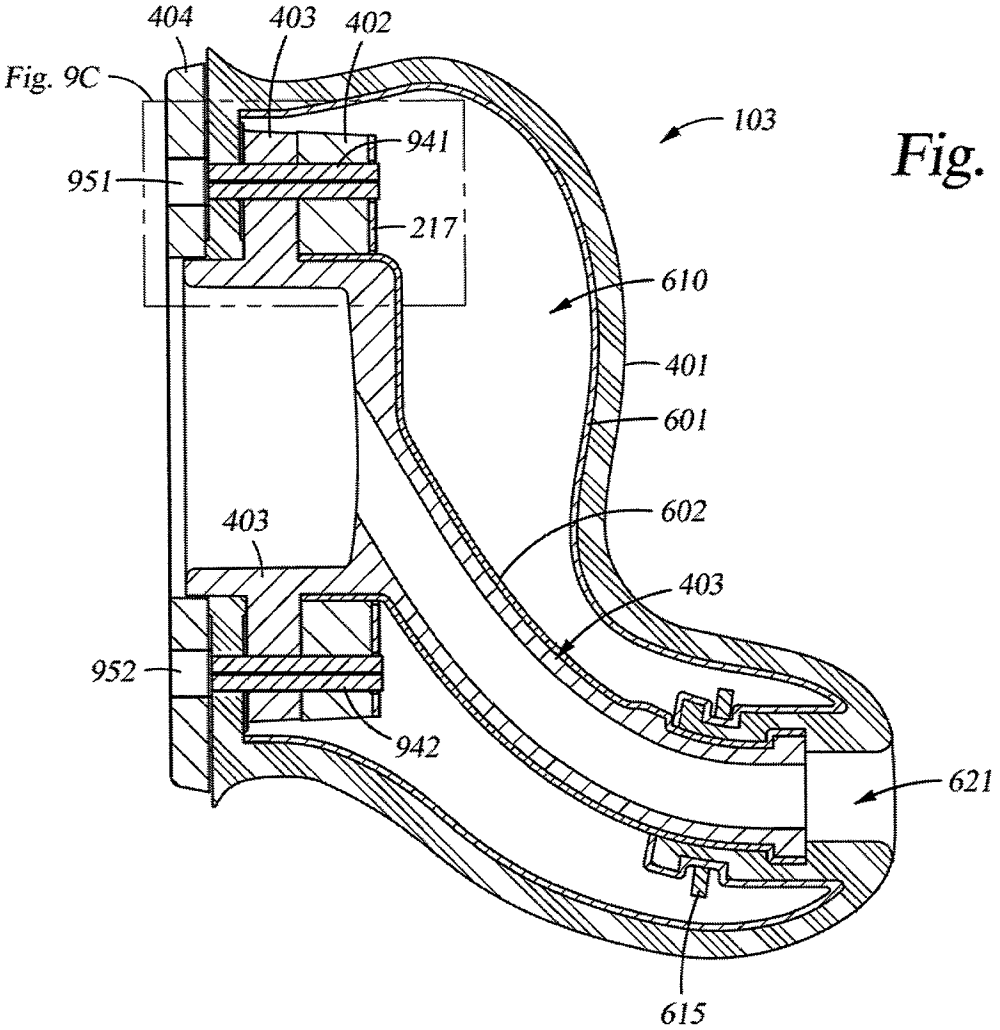
FIG. 9B illustrates a cross-sectional view of a customizable ear insert and some components for adding the curable filler material to the customizable ear insert, according to one embodiment.

FIG. 9B shows a cross-sectional view of a customizable ear insert 103 and some components for adding the curable filler material 801 to the customizable ear insert 103, according to one embodiment. The customizable ear insert 103 is the same as the customizable ear insert 102 except that the customizable ear insert 103 includes flat tubing that extends through the sound tube assembly 403, the support spacer 402, and the flexible PCB 217 instead of the tubes 423 and holes 921, 922 of the customizable ear insert 102 shown in FIG. 9A. The customizable ear insert 103 includes a first flat tube 941 and a second flat tube 942 that each extend through holes in the sound tube assembly 403, the support spacer 402, and the flexible PCB 217 to connect the inner volume 610 of the sleeve assembly 401 to the external environment. The support 404 can include a first hole 951 and a second hole 952 that line up with the first flat tube 941 and the second flat tube 942 respectively.

The first flat tube 941 can be used to add the curable filler material 801 to the inner volume 610 of the sleeve assembly 401. The second flat tube 942 can be used to apply suction to the inner volume 610 of the sleeve assembly through the second flat tube 942 to assist in distributing the curable filler material 801 throughout the inner volume 610 of the sleeve assembly 401. The sound tube assembly 403, the support spacer 402, and the flexible PCB 217 can be formed of flexible, compressible materials that can allow the flat tubes 941, 942 to be expanded when the curable filler material 801 is added through the first flat tube 941 and the suction is applied to the inner volume 610 through the second flat tube 942. In one embodiment, balloon catheters can be used to expand the flat tubes 941, 942 during addition of the curable filler material 801 to the inner volume 610.

Figure 9C:
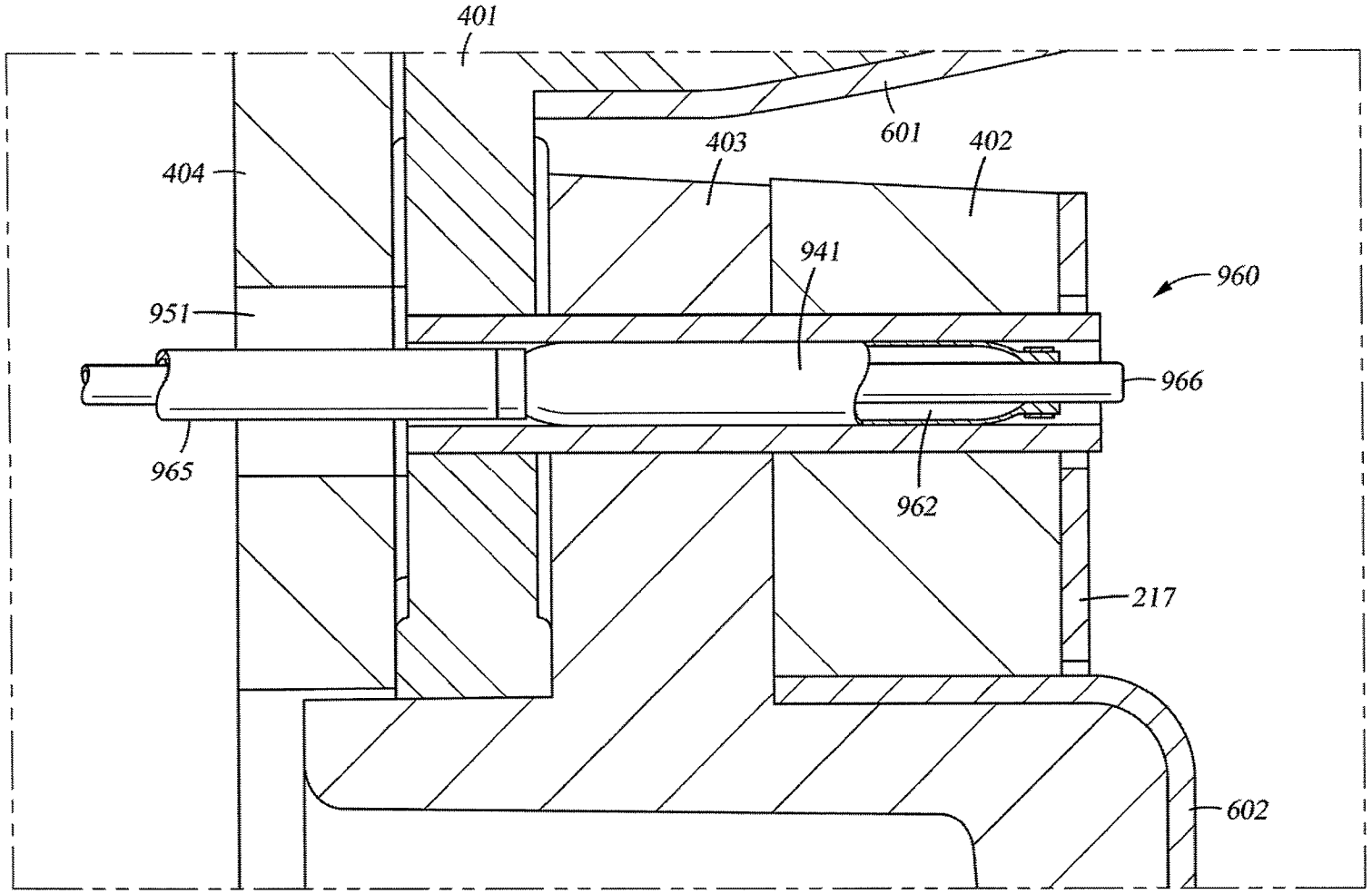
FIG. 9C illustrates a balloon catheter that has been used to expand the first flat tube of FIG. 9B, according to one embodiment.

FIG. 9C shows a balloon catheter 960 that has been used to expand the first flat tube 941 of FIG. 9B, according to one embodiment. FIG. 9C is an enlarged view of the area 9C shown in FIG. 9B after the balloon catheter expands the first flat tube 941. The balloon catheter 960 includes a pointed tip 966 to facilitate insertion of the balloon catheter 960 into the first flat tube 941. The balloon catheter 960 further includes a central channel 965 and one or more balloons 962. In one embodiment, a first balloon catheter 960 is used to expand the first flat tube 941 and a second balloon catheter 960 is used to expand the second flat tube 942. When the first flat tube 941 is expanded, the central channel 965 of the first balloon catheter 960 can be used to insert a syringe, such as the syringe 901 of FIG. 9A, to add the curable filler material 801 to the inner volume 610 of the sleeve assembly 401. When the second flat tube 942 is expanded, the central channel 965 of the second balloon catheter 960 can be used to connect a vacuum tube, similar to the vacuum tube 902 of FIG. 9A, so that suction can be applied to the inner volume 610 assist in distributing the curable filler material 801 throughout the inner volume 610 of the sleeve assembly 401. After adding the curable filler material 801 to the inner volume 610 of the sleeve assembly 401, the balloon catheters 960 can be removed from the flat tubes 941, 942 which restores the flat tubes 941, 942 to the flat state shown in FIG. 9B. After removal of the balloon catheters 960, the compression placed on the flat tubes 941, 942 by components, such as the support spacer 402 and the sound tube assembly 403 can be sufficient to seal the flat tubes 941, 942, so that a separate sealing step is not required to contain the curable filler material 801 in the inner volume 610 of the sleeve assembly 401.

Figure 10:
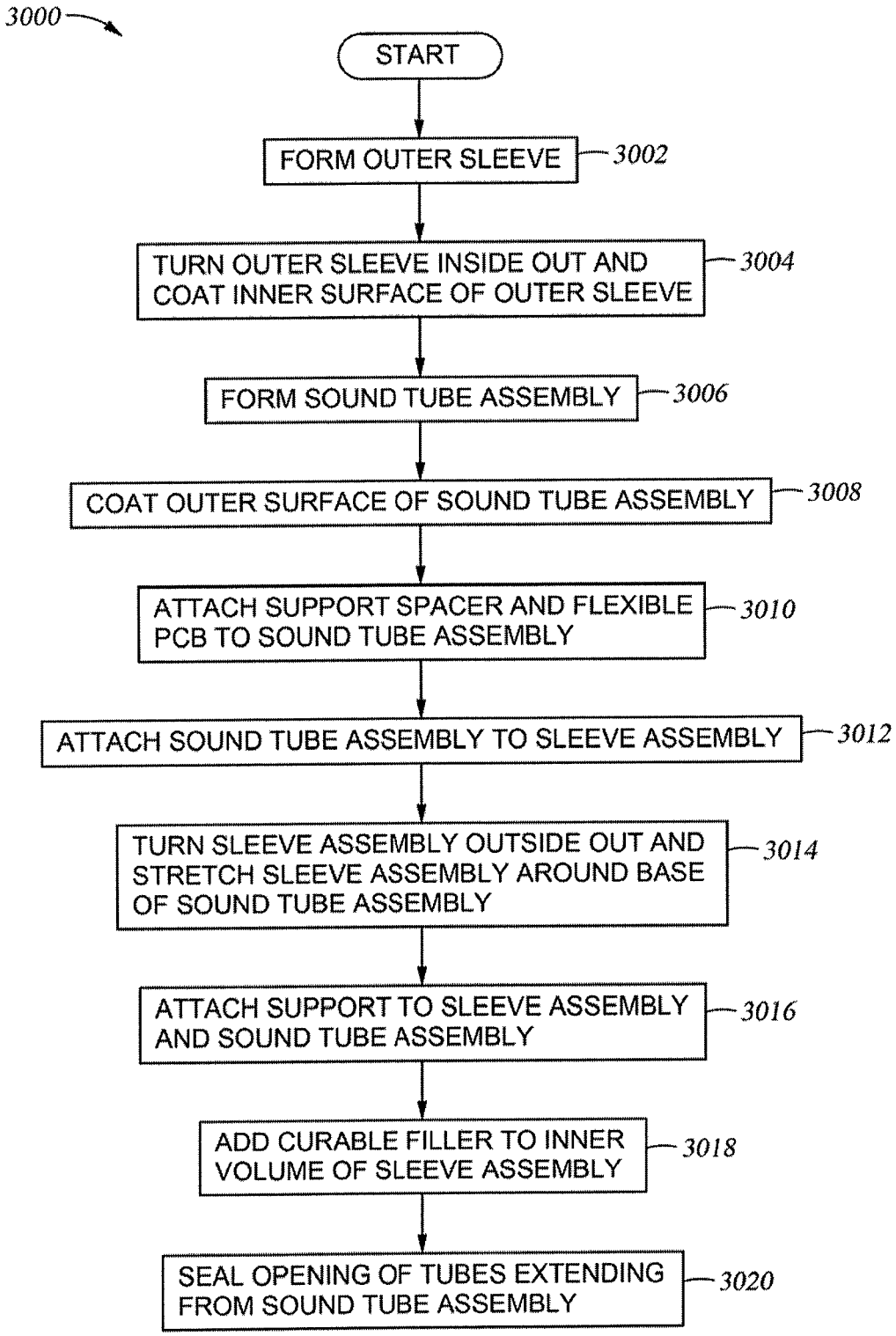
FIG. 10 is a process flow diagram of a method for manufacturing the customizable ear insert and the customizable ear insert.

FIG. 10 is a process flow diagram of a method 3000 for manufacturing the customizable ear insert 102 and the customizable ear insert 103. Although the method steps are described in conjunction with the systems and components shown in FIGS. 1-9C, persons skilled in the art will understand that any system configured to perform the method steps, in any order, is within the scope of the present disclosure provided herein.

Referring to FIGS. 1-9C, the method 3000 is described. At block 3002, the sleeve 600 is formed. The sleeve 600 can be formed using various molding processes, such as compression molding, injection molding, and dip molding. At block 3004, the sleeve 600 can be turned inside out and the inner surface of the sleeve (i.e., the surface that is facing out after turning the sleeve 600 inside out) can be coated with the interior coating 601. The interior coating 601 can be placed on the sleeve 600 using spray coating, spin coating, or physical vapor deposition.

At block 3006, the sound tube assembly 403 can be formed. The sound tube assembly 403 can be formed using various molding processes, such as compression molding, injection molding, and dip molding. At block 3008, the sound tube assembly 403 can optionally be coated with the reflective outer coating 602. In some embodiments, the sound tube 422 may include a reflective material, and thus the reflective outer coating 602 can be omitted.

At block 3010, the support spacer 402 and the flexible PCB 217 can be attached to the base 421 of the sound tube assembly 403, for example by using fasteners. At block 3012, the sound tube assembly 403 can be attached to the sleeve assembly 401. For example, in one embodiment the clasp 615 can be used to secure the sound tube 422 to the inward protrusion 622 of the sleeve assembly 401.

In an alternative embodiment, the sound tube assembly 403 can be formed first using the molding process described for block 3006, and then the sleeve assembly 401 can be overmolded onto the sound tube assembly 403. For example, in one embodiment, the sleeve assembly 401 can overmolded onto the sound tube assembly 403, so that the sleeve assembly 401 is formed inside out and the sleeve assembly 401 is attached to the sound tube assembly 403 near the end of the sound tube 422, for example around the area where the clasp 615 is shown in FIG. 6. In some embodiments, in which the sleeve assembly 401 is overmolded onto the sound tube assembly 403, the clasp 615 can be omitted. After overmolding the sleeve assembly 401 inside out and onto the sound tube assembly 403, the inside of the sleeve assembly 401 and the outside of the sound tube assembly 403 can be coated with the respective reflective coatings at the same time. After coating the sleeve assembly 401 and the sound tube assembly 403, block 3010 can be performed, so the support spacer 402 and the flexible PCB 217 can be attached to the base 421 of the sound tube assembly 403, for example by using fasteners.

At block 3014, the sleeve assembly 401 is turned outside out and stretched around the base 421 of the sound tube assembly 403, so that the tubes 423 of the sound tube assembly 403 can extend through the collar 411 of the sleeve assembly 401. At block 3016, the support 404 can be attached to the sound tube assembly 403, for example by using a fastener that extends through the support 404, the collar 411 of the sleeve assembly 401 and into the base 421 of the sound tube assembly 403.

At block 3018, the curable filler material 801 can be added to the inner volume 610 of the sleeve assembly 401. For the customizable ear insert 102 (see FIG. 9A), the curable filler material 801 can be added, for example, by inserting the syringe 901 into one of the tubes 423 and attaching the vacuum tube 902 to another one of the tubes 423 as described above in reference to FIG. 9A.

In one embodiment, for an alternate configuration of the customizable ear insert 103 (see FIG. 9B), a catheter 960 can be inserted into each of the flat tubes 941, 942, so that a syringe can be inserted into the first flat tube 941 for adding the curable filler material 801 and a vacuum tube can be attached to the second flat tube 942 to facilitate distributing the curable filler material 801 throughout the inner volume 610 as described above in reference to FIGS. 9B and 9C. At block 320, after adding the curable filler material 801 to the inner volume 610, the openings for the tubes 423 can be sealed. In one embodiment, TPU plugs can be inserted into the tubes 423 and then the tubes can be clipped using heated shears, which can weld any remaining opening shut. The customizable ear insert 103 (see FIG. 9B) does not require a separate sealing step since the compression placed on the flat tubes 941, 942 by components, such as the support spacer 402 and the sound tube assembly 403 can be sufficient to seal the flat tubes 941, 942 when the catheters 960 are removed.

Figure 11:
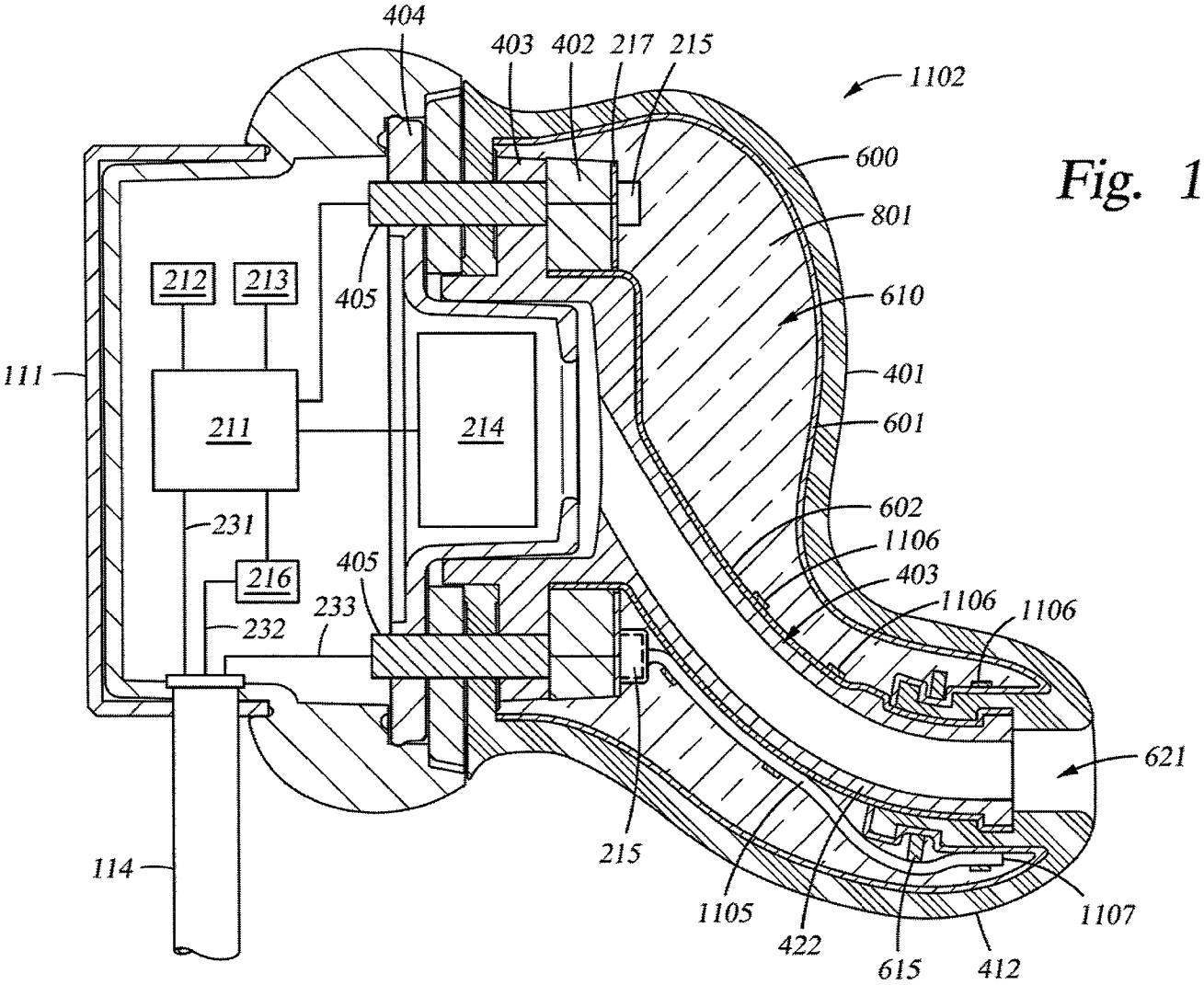
FIG. 11 illustrates a cross-sectional view of a customizable ear insert after the curable filler material has been added to the customizable ear insert, according to one embodiment.

FIG. 11 shows a cross-sectional view of a customizable ear insert 1102 after the curable filler 801 has been added to the customizable ear insert 1102, according to one embodiment. The customizable ear insert 1102 is similar to the customizable ear insert 102 described above except that the customizable ear insert 1102 includes a fiber optic cable 1105 extending from one of the radiation sources 215 to the ear tip 412 of the sleeve assembly 401. The fiber optic cable can be embedded in the curable filler material 801. The fiber optic cable 1105 can be secured to the sound tube 422, for example, by using one or more clasps 1106. In one embodiment, the one or more clasps are elastic rings. The fiber optic cable 1105 can include an end 1107 positioned in the ear tip 412 of the customizable ear insert 1102 for emitting light directly into curable filler material 801 located in the ear tip 412. Emitting light directly into the curable filler material 801 can increase the cure rate of the curable filler material 801 located in the ear tip 412 and can also promote a fuller cure of the curable filler material 801 located in the ear tip 412 when compared to the customizable ear insert 102 that only emits light from the radiation sources 215 located near the base 421 of the sound tube assembly 403.

The customizable ear insert 1102 includes one or more radiation sources 215 that are not connected to a fiber optic cable. These radiation sources 215 emit light into the curable filler material from some of the same locations described above for the customizable ear insert 1102, which is near the base 421 of the sound tube assembly 403. Furthermore, although only one fiber optic cable 1105 is shown in FIG. 11, the customizable ear insert 1102 can include two or more fiber optic cables 1105 coupled to radiation sources 215. These fiber optic cables 1105 can extend to different locations inside the sleeve assembly 401 to further balance the distribution of light during the curing of the curable filler material 801. By having some light emitted from one or more radiation sources 215 near the base 421 of the sound tube assembly 403 and light emitted from the ends of fiber optic cables located at various locations in the sleeve assembly 401, such as in the ear tip, the curable filler material 801 in different locations in the sleeve assembly 401 can be exposed to light in a more similar manner, which can promote curing of the curable filler material 801 in these different locations at more equal rates than for the customizable ear insert 102 described above. By reducing the variability in the cure rate of the curable filler material 801 in different locations in the sleeve assembly 401, mechanical stresses caused by different cure rates can be reduced. These mechanical stresses can disturb the bonding between the curable filler material 801 and the sleeve assembly 401 and ultimately reduce the reliability and useful life of the customizable ear inserts. Thus, by using one or more fiber optic cables 1105 to distribute light from the radiation sources 215 to different locations inside the sleeve assembly, such as in the ear tip 412, can improve the reliability and useful life of the customizable ear inserts 1102.

Figure 12:
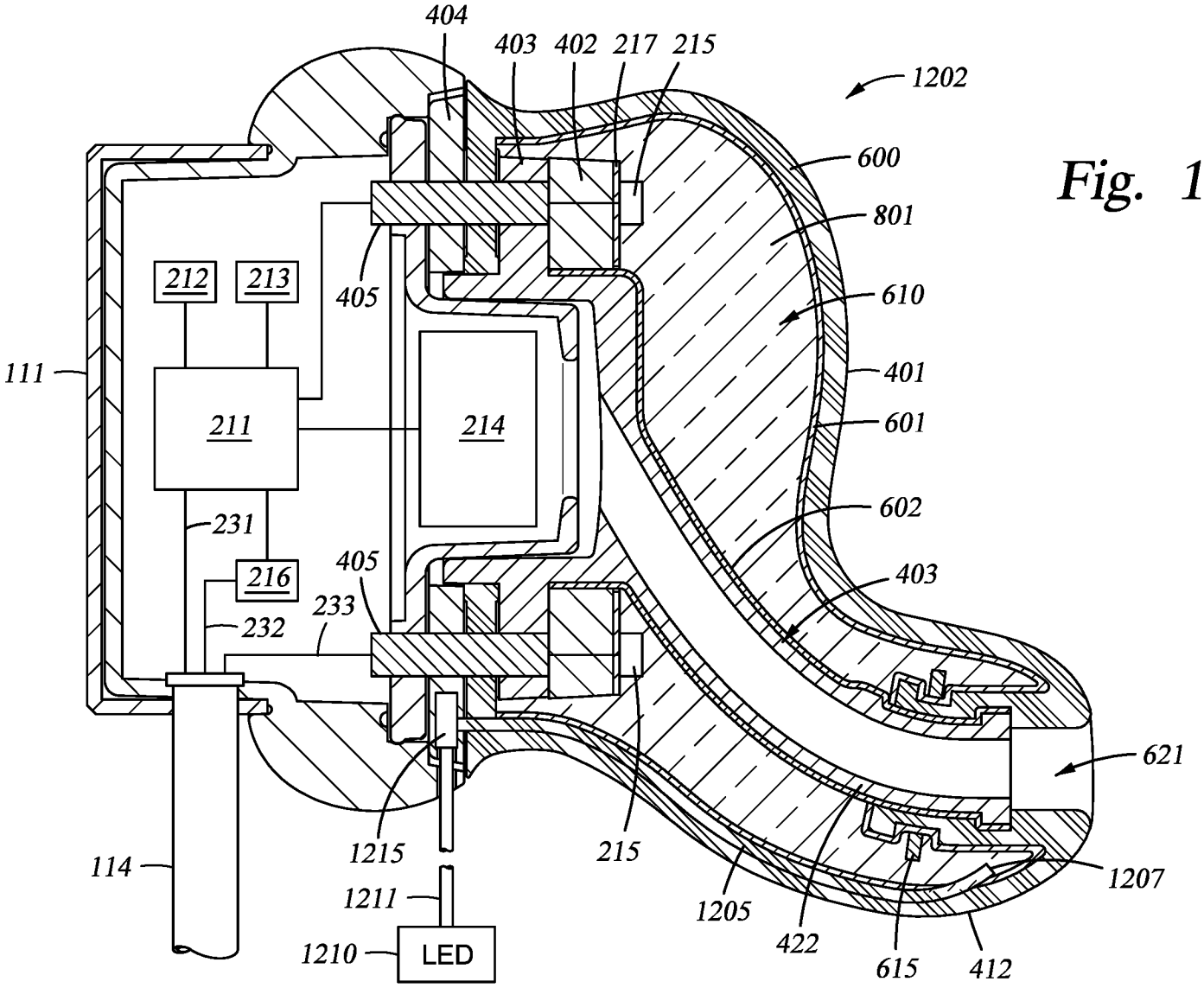
FIG. 12 illustrates a cross-sectional view of a customizable ear insert after the curable filler material has been added to the customizable ear insert, according to one embodiment.

FIG. 12 shows a cross-sectional view of a customizable ear insert 1202 after the curable filler material 801 has been added to the customizable ear insert 1202, according to one embodiment. The customizable ear insert 1202 is similar to the customizable ear insert 102 described above except that the customizable ear insert 1202 includes a fiber optic cable 1205 extending from the support 404 to the ear tip 412 inside the sleeve assembly 401. The fiber optic cable 1205 can be embedded in the sleeve assembly 401 between the sleeve 600 and the interior coating 601. The fiber optic cable 1205 can include an end 1207 positioned in the ear tip 412 of the customizable ear insert 1202 for emitting light directly into curable filler material 801 located in the ear tip 412. Emitting light directly into the curable filler material 801 can increase the cure rate of the curable filler material 801 located in the ear tip 412 and can also promote a fuller cure of the curable filler material 801 located in the ear tip 412 when compared to the customizable ear insert 102 that only emits light from the radiation sources 215 located near the base 421 of the sound tube assembly 403.

In some embodiments, the fiber optic cable 1205 can connect to an external LED 1210. A fiber optic cable 1211 can transmit light from the external LED to the fiber optic cable 1205 that transmits the light to the curable filler material 801 in the sleeve assembly 401. A fiber optic coupling 1215 can be used to couple the fiber optic cable 1211 to the fiber optic cable 1205. The fiber optic cable 1205 can serve to promote a fuller cure of the curable filler material in the ear tip 412 and to balance the cure rate of the curable filler material 801 in the ear tip 412 with the curable filler material 801 in other locations in the sleeve assembly 401 in a similar manner as described above in reference to FIG. 11 and the fiber optic cable 1105.

In some embodiments in which an external LED is used to transmit light into the sleeve assembly 401 with a fiber optic cable, the radiation sources 215, the flexible PCB 217, and the support spacer 402 can be omitted. In some of these embodiments, more than one fiber optic cable or a fiber optic cable with multiple branches can be used to transmit light to different locations inside the sleeve assembly 401 to balance the cure rate of the curable filler material 801 in the different locations with each other to reduce the mechanical stresses caused by cure rate variability as described above in reference to FIG. 11.

Figure 13:
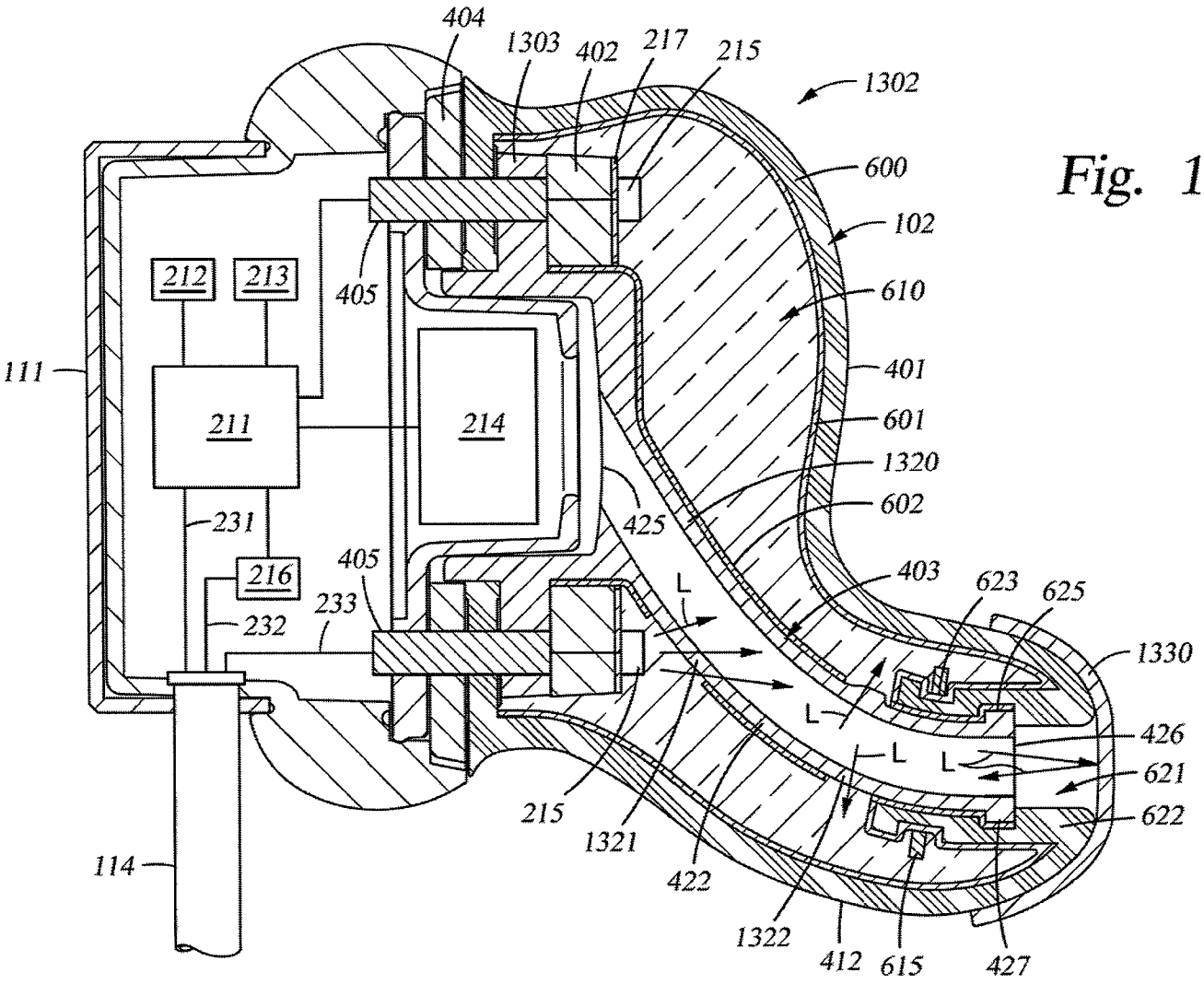
FIG. 13 illustrates a cross-sectional view of a customizable ear insert before the curable filler material has been added to the customizable ear insert, according to one embodiment.

FIG. 13 shows a cross-sectional view of a customizable ear insert 1302 before the curable filler material 801 has been added to the customizable ear insert 1302, according to one embodiment. The customizable ear insert 1302 is similar to the customizable ear insert 102 described above except that the customizable ear insert 1302 includes a sound tube assembly 1303 instead of the sound tube assembly 403 included in the customizable ear insert 102. The sound tube assembly 1303 includes a transparent sound tube 1320. The transparent sound tube 1320 can be transparent to the energy emitted by the radiation sources 215, such as light having a wavelength of 405 nm. The transparent sound tube 1320 can be partially coated with the reflective outer coating 602 described above. The reflective outer coating 602 can be opaque to the energy emitted by the radiation sources 215.

The sound tube 1320 can include a first portion 1321 and a second portion 1322 that are not coated by the outer coating 602. The first portion 1321 can be located near one of the radiation sources 215. The second portion 1322 can be located in the ear tip 412 of the sleeve assembly 401. Light L from the radiation source 215 near the first portion 1321 can be transmitted into the sound tube 1320, and this light L can then be transmitted out of the sound tube 1320 at the second portion 1322 to the curable filler material (not shown) located in the ear tip 412. In some embodiments, an opaque reflective cap 1330 can be placed over the ear tip 412, so that the light L in the sound tube 1320 is not directed at the user. This opaque, reflective cap 1330 can be especially important if the radiation sources 215 emit UV energy since exposure to UV energy should be avoided. The fiber optic cable 1205 can include an end 1207 positioned in the ear tip 412 of the customizable ear insert 1202 for emitting light directly into curable filler material 801 located in the ear tip 412. Emitting light into the curable filler material 801 in ear tip 412 through the second portion 1322 of the sound tube 1320 can increase the cure rate of the curable filler material 801 located in the ear tip 412 and can also promote a fuller cure of the curable filler material 801 located in the ear tip 412 when compared to the customizable ear insert 102 that only emits light from the radiation sources 215 into the curable filler material 801 located near the base 421 of the sound tube assembly 403.

In another embodiment, a sound tube assembly that includes variations in transparency can be used to further balance the distribution of light to the curable filler material during the customization process. For example, in one embodiment, a transparent sound tube assembly can be formed, and then different portions of the sound tube can be coated with varying amounts of an opaque or semi-transparent coating so that the transparency of the sound tube gradually varies along the length of the sound tube. The sound tube assembly may still include a more fully transparent portion adjacent to the radiation source 215 similar to the first portion 1321 described above. In one such embodiment, the transparency of the sound tube (excluding the more fully transparent portion near the radiation source 215) can gradually increase as the sound tube extends towards the ear tip 412. The ear tip 412 may also include a more fully transparent portion similar to the second portion 1322 described above. A gradual variance in the transparency of the sound tube can help to balance the light emitted upon different portions of the curable filler material, so that the cure rate of the different portions can be more uniform.

Figure 14A:
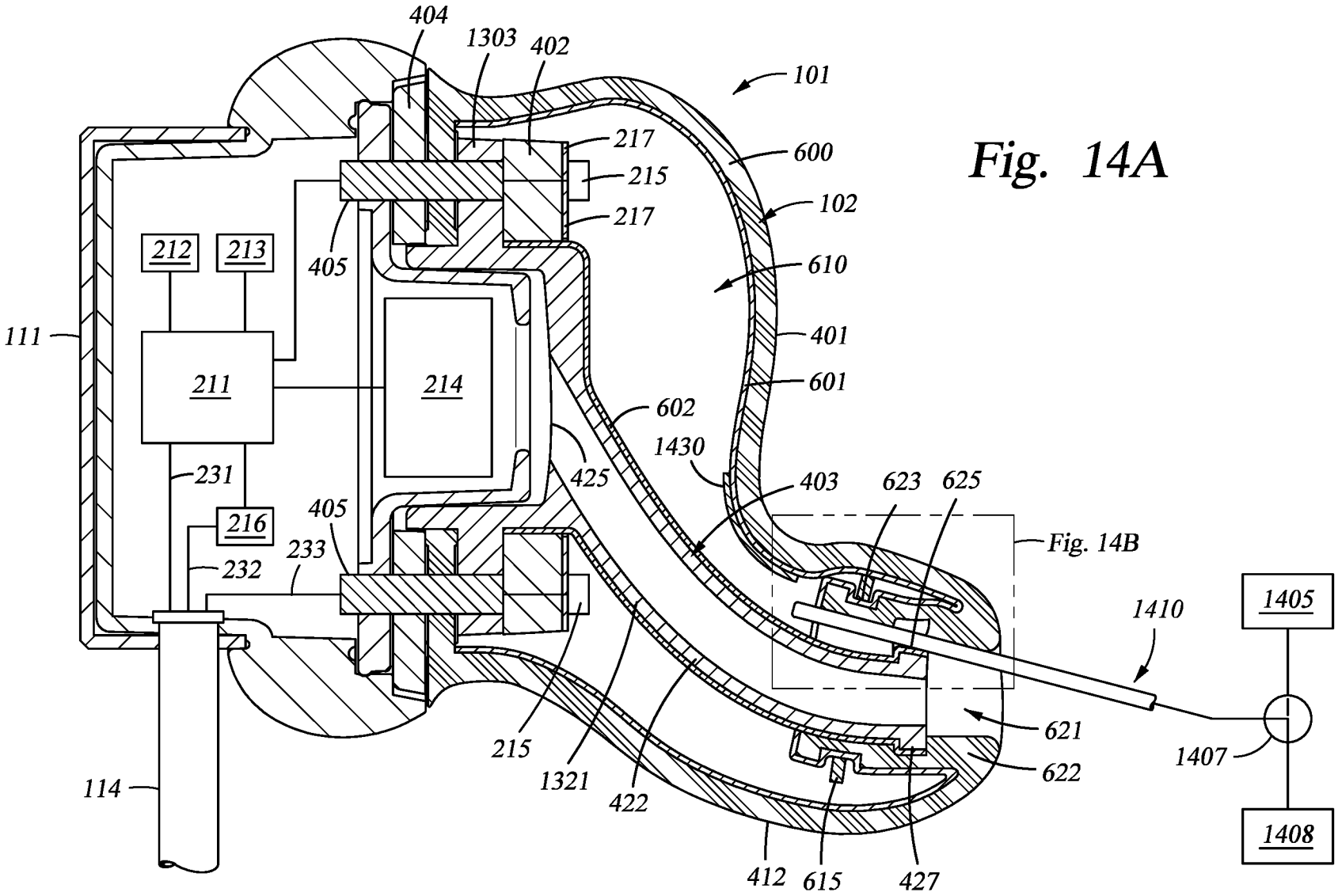
FIG. 14A is a cross-sectional view of the customizable ear insert before the curable filler material has been added to the customizable ear insert, according to at least one embodiment.
Figure 14B:
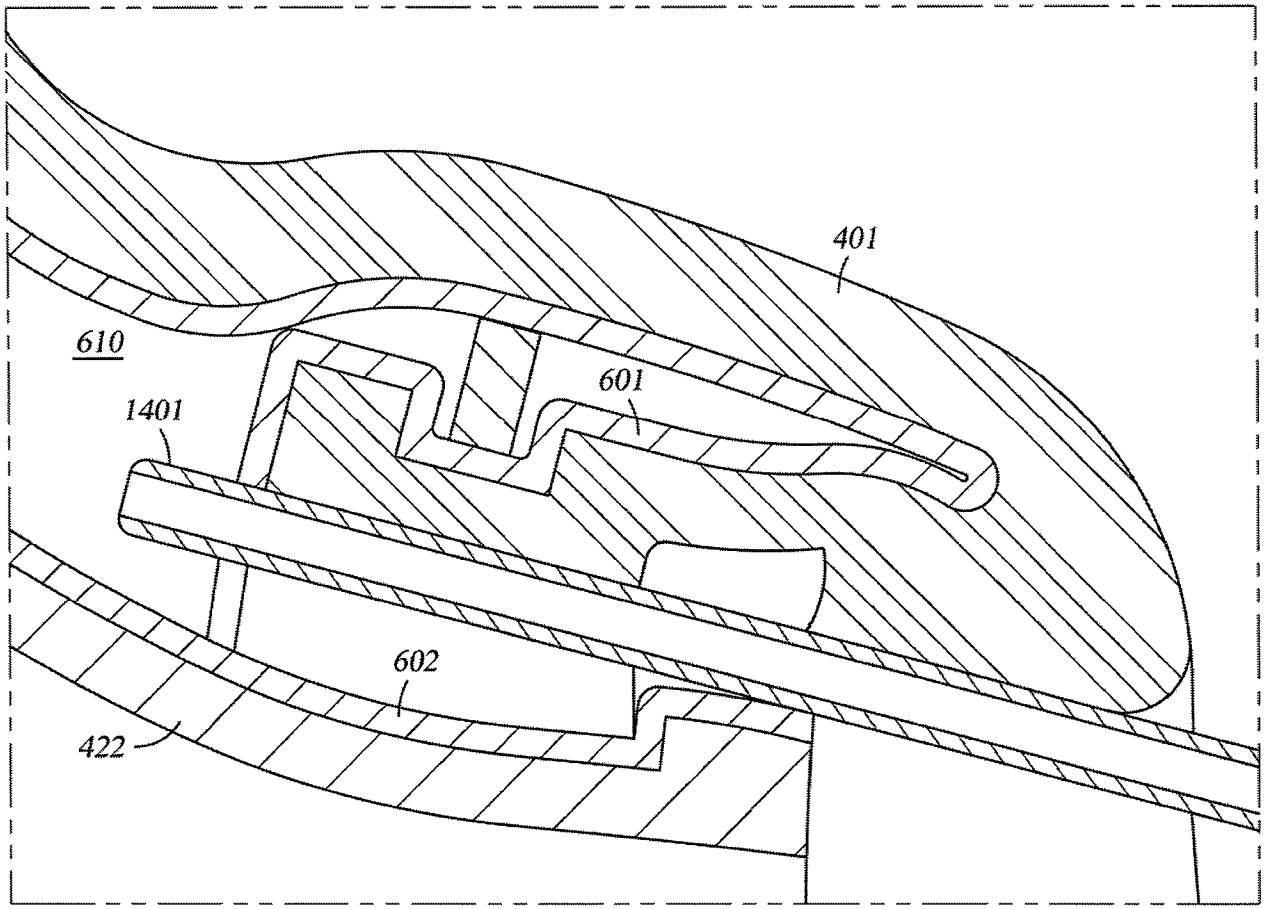
FIG. 14B is a close up sectional view of a portion of the customizable ear insert illustrated in FIG. 14A, according to at least one embodiment.

FIG. 14A is a cross-sectional view of the customizable ear insert 102 before the curable filler material 801 has been added to the customizable ear insert 102, according to at least one embodiment. FIG. 14B is a close up cross-sectional view of a portion of FIG. 14A. In conventional devices, the curable filler material 801 may not easily travel or flow through the inner volume 610 from the audio assembly 111 end of the customizable ear insert 102, as discussed above in conjunction with FIGS. 9A-9C, to the opposing end near the ear tip portion 412, leaving the ear tip portion 412 with a partially filled region or void near the ear tip portion 412. An unfilled ear tip portion 412 can lead to an inability to control or maintain the shape of the ear tip portion 412 after the curing process has been performed, which can lead to variability in how well the customizable ear insert 102 fits within a user's ears and/or discomfort for user. However, in these embodiments, the curable filler material 801 is injected into the inner volume 610 at the ear tip portion 412 of the customizable ear insert 102. More specifically, the tube 1401 can be inserted between the sleeve assembly 401 and the sound tube 422 as shown in FIG. 14B. Then the curable filler material 801 can be inserted into the ear tip portion 412 leading to an increased ability to fill the inner volume 610, which is typically the portion inserted into a user's ear. As such, the proper filling of the inner volume 610 and subsequent curing of the curable filler material 801 in the ear tip portion 412 ensures that the customizable ear insert 102 will comfortably and reliably fit the same way each time it is inserted within the user's ear.

During the manufacturing process, in one embodiment, the curable filler material 801 is injected into the ear tip portion 412 using a filling device 1410 that includes a tube 1401 that is coupled to a curable filler material source 1405. Before injection, the curable filler material 801 is contained within the curable filler material source 1405 that is fluidly coupled to the tube 1401. Thereafter, the tube 1401 is inserted through the ear tip portion 412 of the ear insert 102. Due to pressure applied to the curable filler material 801 from a pressure controlling device (e.g., gas source, manual user compressible component) in the curable filler material source 1405, the curable filler material 801 will flow through the tube 1401 and into the area of the inner volume 610 where the tube 1401 is inserted. In some embodiments, the tube 1401 can have a valve 1407 and actuator 1408. The valve 1407 can be used to selectively apply the curable filler material 801 into the inner volume 610 from the curable filler material source 1405, and, alternatively, the actuator 1408 can be used to pull air out of the inner volume 610, by a pumping action.

Figure 14C:
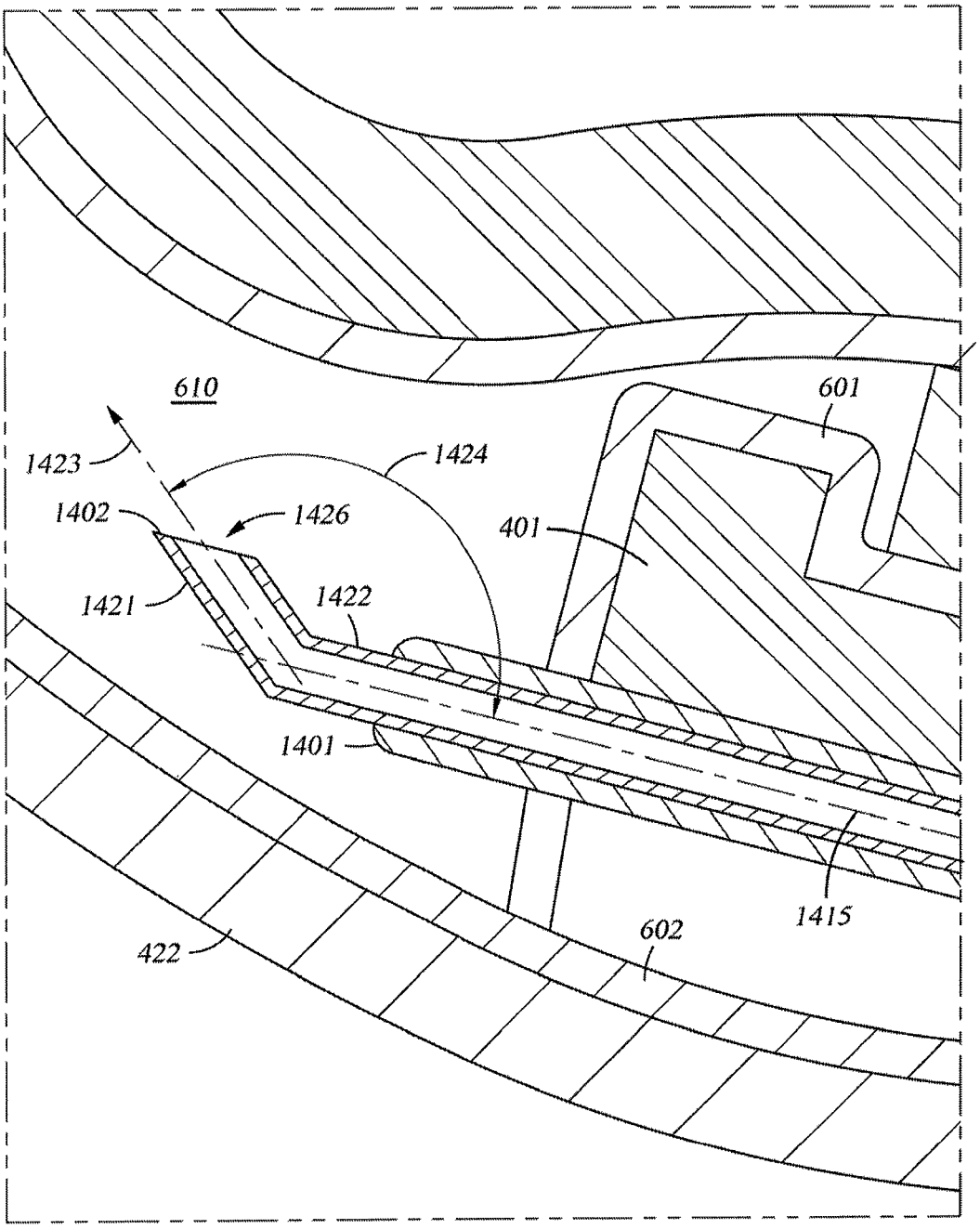
FIG. 14C is a close up sectional view of a portion of the customizable ear insert illustrated in FIG. 14A, according to at least one embodiment.

FIG. 14C is a cross-sectional view of the customizable ear insert 102 before the curable filler material 801 has been added to the customizable ear insert 102, according to at least one embodiment. In these embodiments, a needle 1402 is used in combination with the tube 1401 to better control the insertion of the curable filler material 801 and minimize the chances of puncturing the sleeve 600 of the sleeve assembly 401 by use of a flexible needle 1402. The needle 1402 can be a pre-formed deformable material containing flexible needle made out of nickel titanium, for example. The needle 1402 can be pre-formed such that in its normal state, such as prior to insertion into the tube 1401, the needle 1402 has a shape that that has a bend in it. In this case, the needle 1402 is configured to be positioned within inner diameter of the tube 1401, and is further configured to slide within the tube 1401. The tube 1401 is adapted to hold the needle 1402 in an unbent or straight configuration until the needle 1402 is advanced through the tube 1401 at which point the needle 1402 extends past the outlet end of the tube 1401, thus allowing the needle 1402 to bend and return to its un-deformed shape. The needle 1402 is held straight while it is in a retracted position within the tube 1401. In other embodiments, as shown best in FIG. 14C, the needle 1402 is advanced out of the tube 1401 such that it bends and returns to its preformed shape. The preformed bend in the needle 1402 can then be positioned and oriented by the user so that the outlet 1426 of the needle 1402 is oriented towards the end of the inner volume 610 near the ear tip portion 412. In some cases, the outlet 1426 of the needle 1402 can be oriented parallel to the sidewall of the sound tube 422 or a portion of the sleeve 600 near the ear tip portion 410, preventing the end portion of the needle 1402 near the outlet 1426 from piercing through the sound tube 422 or the sleeve 600. As shown in FIG. 14C, the needle 1402 has a first portion 1422 and a second portion 1421. The first portion 1422 is substantially parallel to a direction 1415, the direction 1415 is substantially parallel to the sidewalls of the tube 1401. The first portion 1422 of the needle 1402 is held in this orientation by the sidewalls of the tube 1401, preventing the first portion 1422 from flexing to the pre-formed shape of the needle 1402. The second portion 1421 is substantially parallel to a direction 1423, the direction 1423 is substantially parallel to the sidewall of the sound tube 422. The second portion 1421 of the needle 1402 is not held in place by the sidewalls of the tube 1401, and therefore flexes into its pre-formed shape. As such, the needle 1402 is bent an angle 1424 between the direction 1415 and the direction 1423, preventing the end of the outlet 1426 of the needle 1402 from piercing through the sound tube 422 and the sleeve 600. Instead, the outlet 1426 of the needle 1402 is located toward the center of the inner volume 610.

Additionally, in some embodiments, shields 1430A (FIG. 14A) and/or 1430B are located within the inner volume 610 to prevent the end portion of the needle 1402, at the outlet 1426, from piercing through the sleeve assembly 401 when inserting the curable filler material 801 into the inner volume 610 and when pulling air from the inner volume 610. More specifically, the shield 1430A prevents the end portion of the needle 1402 from piercing through the sleeve 600 of the sleeve assembly 401 and the shield 1430B prevents the end portion of the needle 1402 from piercing through the inward protrusion 622 of the sleeve assembly 401. The shields 1430A and 14306 can also include geometric features that prevent the sleeve assembly 401 from collapsing onto the needle 1402, and may include a flexible and puncture resistant material, such as a portion of a sheet of an elastomeric or plastic material (e.g., natural rubber, polyethylene sheet, Mylar sheet).

Figure 14D:
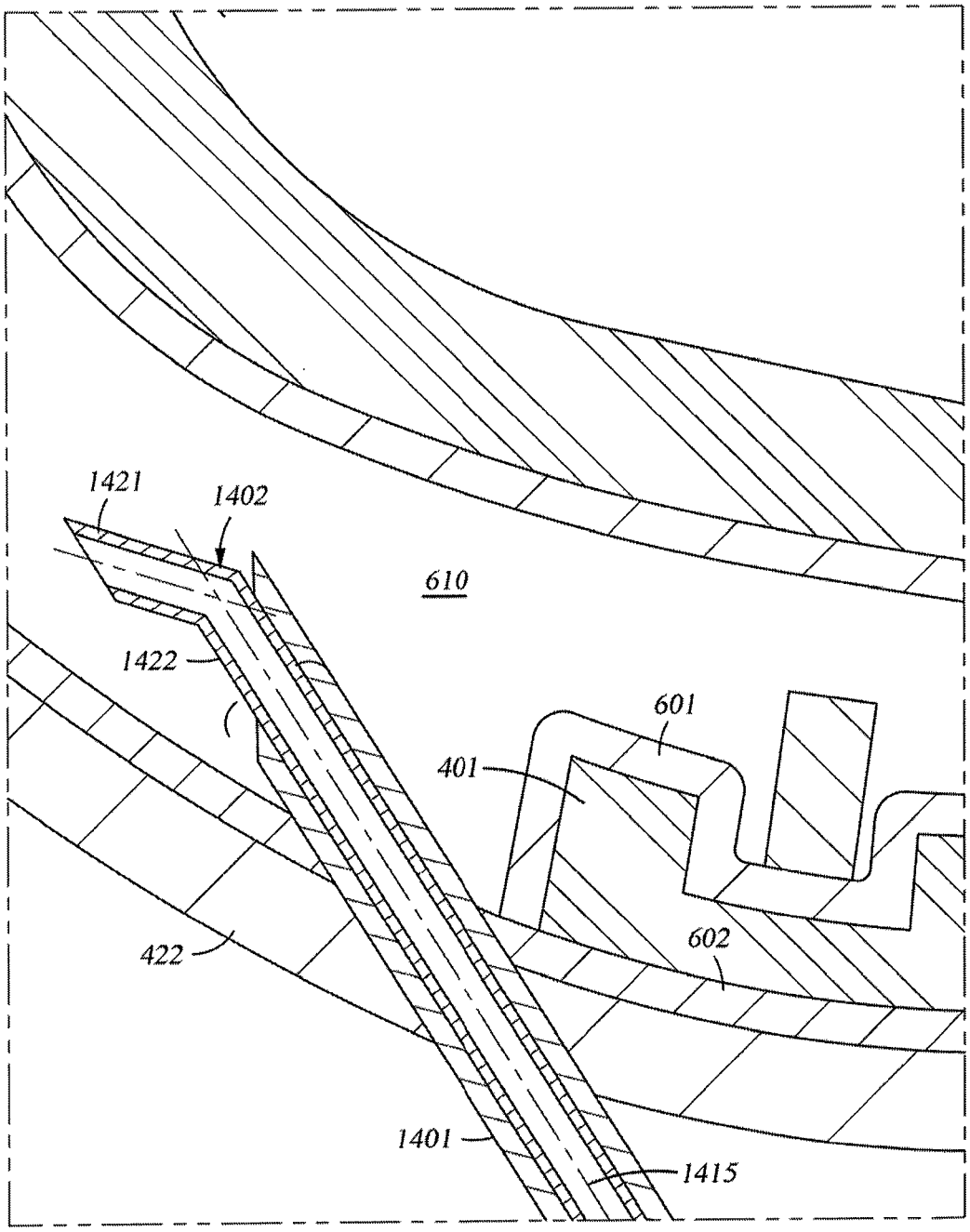
FIG. 14D is a close up sectional view of a portion of the customizable ear insert illustrated in FIG. 14A, according to at least one embodiment.
Figure 14E:
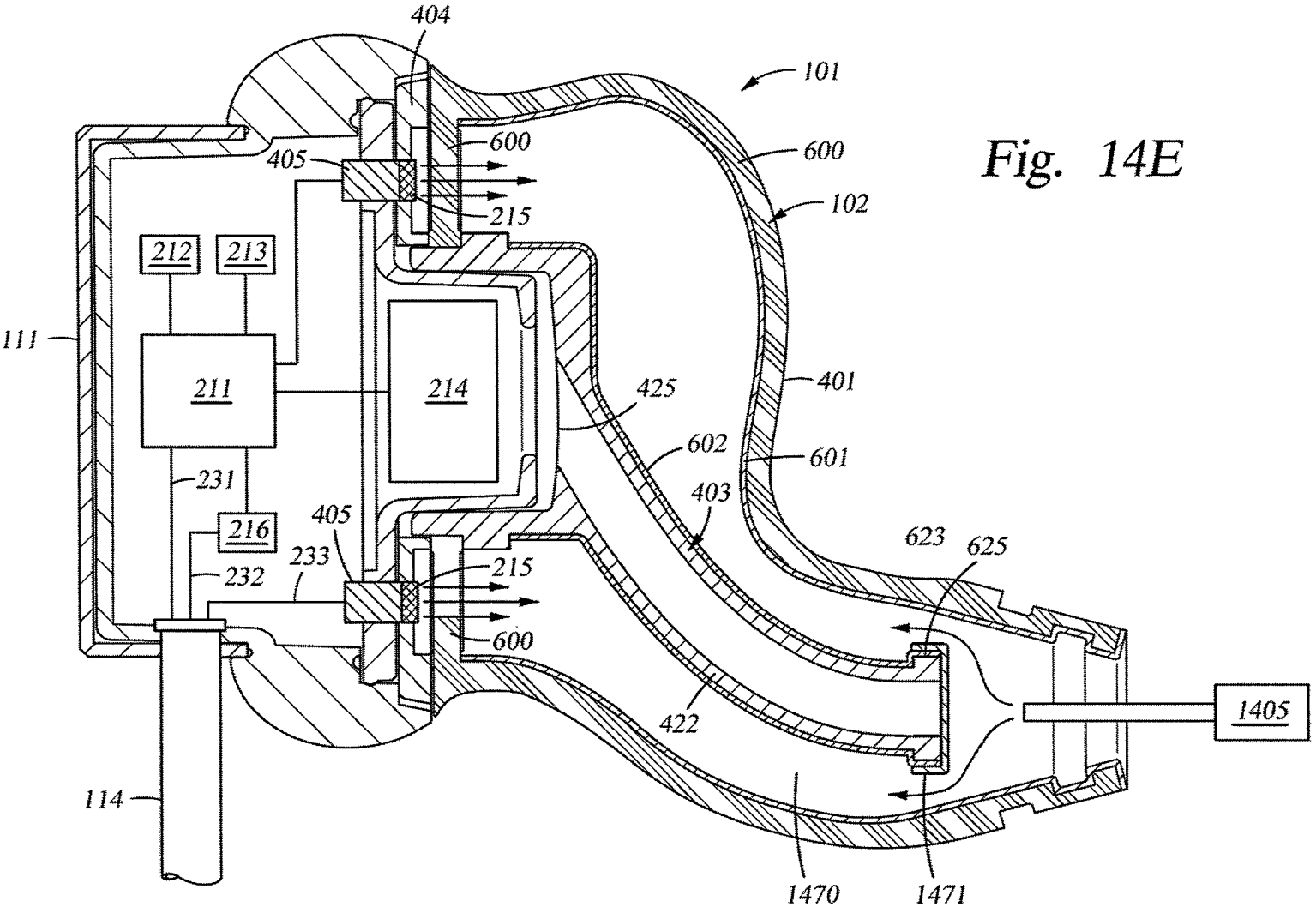
FIG. 14E is a cross-sectional view of the customizable ear insert before the curable filler material has been added to the customizable ear insert, according to at least one embodiment.

In other embodiments, as shown in FIG. 14E, rather than inserting a tube 1401 through the sleeve assembly 401 to inject the curable filler material 801 into the inner volume 610 near the ear tip 412, instead the inward protrusion 622 of the sleeve assembly 401 can be folded from its sealed position over the sound tube 422 at the output region 426 upwards to an open position, creating a space 1470 between the sleeve assembly 401 and the sound tube 422.

Thereafter, the curable filler material 801 can be inserted by the curable filler material source 1405 into the inner volume 610 through a space 1470 formed near the ear tip 412 without having to insert the tube 1401 through the sleeve assembly 401. After insertion of the curable filler material 801 within the inner volume 610, the inward protrusion 622 of the sleeve assembly 401 can be folded from its open position (i.e., FIG. 14E) back into its sealed position (i.e. FIG. 7) over the sound tube 422 at the output region 426 of the sound tube 422. While in the open position, the sound tube 422 can be protected by a cap 1471 such that the curable filler material 801 does not flow within the sound tube 422.

In another embodiment, as shown in FIG. 14D, a tube 1401 is inserted into the customizable ear insert 102 such that it punctures the sound tube 422 and thus allows the needle 1402 to be positioned within the inner volume 610. As similarly described in FIG. 14C, the needle 1402 is held in place by a tube 1401 in its retracted position and then bends to its pre-formed shape when advanced to a desired location past the outlet of the tube 1401. Using a similar configuration as the needle 1402 and the tube 1401 in FIG. 14C, the needle 1402 is configured to bend such that it follows the contour of the sound tube 422 without puncturing the sleeve 600. In some embodiments, the sound tube 422 is made of a self-sealing material (e.g., soft durometer material) to prevent subsequent leakage of the injected curable filler material 801 when the tube 1401 and needle 1402 are removed.

Figure 15A:
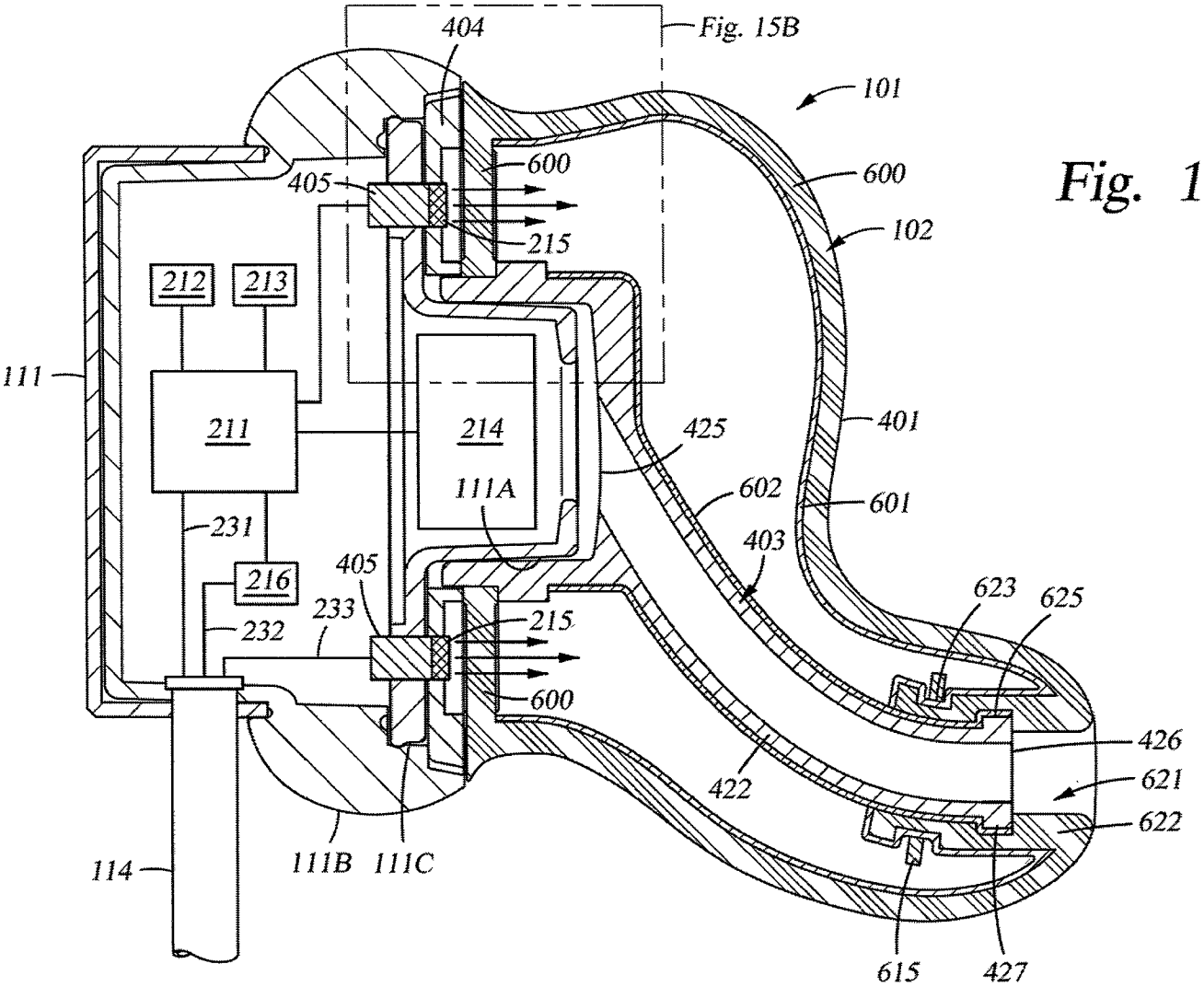
FIG. 15A is a cross-sectional view of a customizable ear insert after the curable filler material has been added to the customizable ear insert, according to at least one embodiment.
Figure 15B:
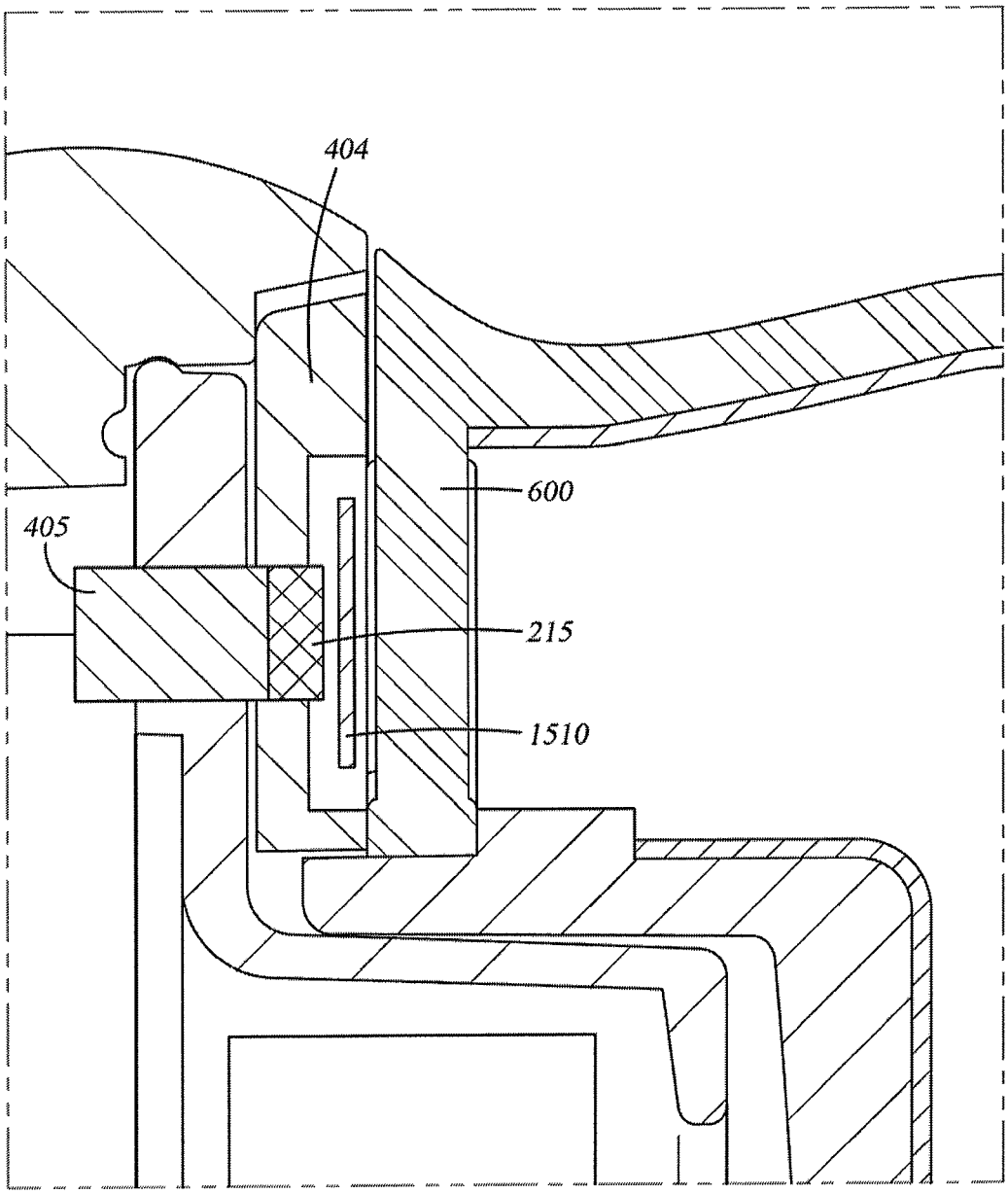
FIG. 15B is a close up cross-sectional view of a portion of the customizable ear insert illustrated in FIG. 15A, according to at least one embodiment.

FIG. 15A is a cross-sectional view of an alternate configuration of the customizable ear insert 102 after the curable filler material 801 has been added to the customizable ear insert 102, according to at least one embodiment. FIG. 15B is a close up cross-sectional view of a portion of FIG. 15A. The configuration illustrated in FIG. 15A is similar to the embodiments shown in FIG. 6, except that the radiation sources 215 are positioned outside the inner volume 610 and within the housing of the audio assembly 111. As shown in FIGS. 15A-15B, the radiation sources 215 are separably coupled to the connectors 405 and lid 111C disposed at an end of the audio assembly 111. In some embodiments, the radiation sources 215 are LEDs that are configured to emit one or more wavelengths of light that can cure the curable filler material 801.

In some embodiments, the LEDs are positioned to output light (L shown in FIG. 15A) which travels through the inner volume 610 and transparent sound tube 422, to cure all of the curable filler material 801 after it has been injected into and fills the inner volume 610. As shown in FIG. 15B, the radiation sources 215 are located outside the inner volume 610 and adjacent to a surface of a portion of the sleeve 600, which does not include the light reflective interior coating 601 or a significant amount of a light reflective material disposed within the material used to form the sleeve 600. Therefore, the output light from the radiation sources 215 will travel through the uncoated portion of the sleeve 600 and into the inner volume 610 to effectively cure the curable filler material 801. In this embodiment, the portions of the sleeve 600 and sound tube 422 through which the output light L (FIG. 15A) needs to travel, to fully cure the curable filler material 801, needs to be optically transparent to the radiation emitted by the radiation sources 215 at the wavelengths used to cure the curable filler material 801. In some configurations of the ear insert 102, the outer coating 602 is not deposited on the sound tube 422 and the interior coating 601 is not deposited on a portion of the sleeve 600, and the sound tube 403 and at least a portion of the sleeve 600 are made of a material that is transparent to one or more of the wavelengths of light emitted from the radiation sources 215.

Also shown in FIG. 15B, one or more optical lenses 1510 can be added to the earphone assembly 101. Each optical lens 1510 can be positioned adjacent to a radiation source 215 such that the lens or portion of the lens can disperse the emitted radiation throughout the inner volume 610 more uniformly, leading to a more uniform cure of the curable filler material 801. The one or more optical lenses 1510 can be a Fresnel lens, spherical lens or other type of lens that is able to desirably direct and disperse the radiation emitted by the radiation sources 215.

Figure 16:
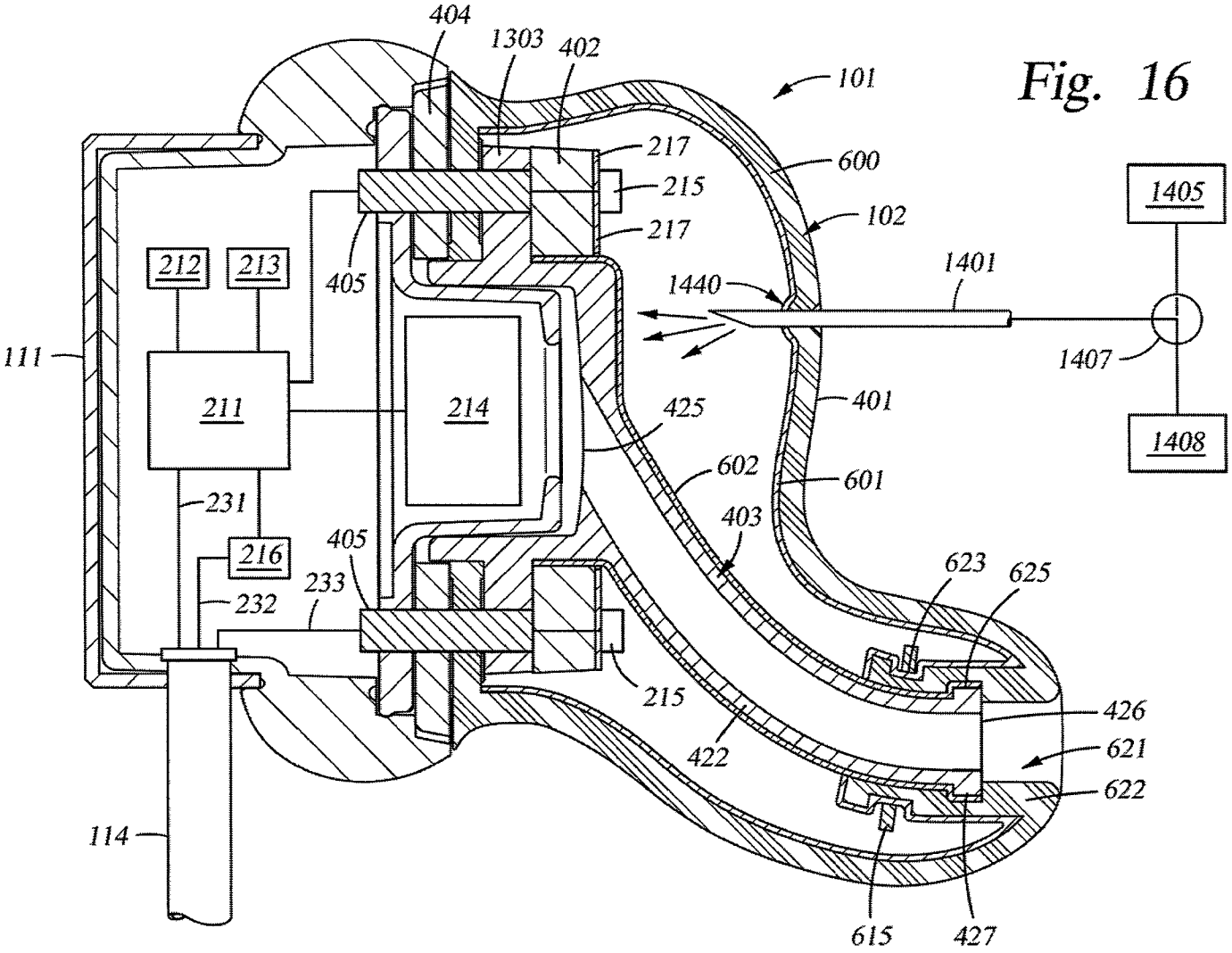
FIG. 16 is a cross-sectional view of the customizable ear insert before the curable filler material has been added to the customizable ear insert, according to at least one embodiment.

FIG. 16 is a cross-sectional view of the customizable ear insert 102 before the curable filler material 801 has been added to the customizable ear insert 102, according to at least one embodiment. In these embodiments, the sleeve 600 can self-seal after the curable filler material 801 is injected into the inner volume 610. As shown in FIG. 16 and as described above in FIGS. 14A-14C, the curable filler material 801 is injected by the tube 1401. Before injection, the curable filler material 801 is contained within a curable filler material source 1405 fluidly coupled to the tube 1401. Thereafter, the tube 1401 is inserted through the sleeve of the ear insert 102. However, in these embodiments, the sleeve 600 contains a region 1440 where the tube 1401 is inserted. The region 1440 is thicker than any other region of the sleeve 600, and thus is configured to form a significant restriction to the flow of the curable filler material 801 from the inner volume 610 to exterior region 1601 after the inner volume 610 has been filled by use of the filling device 1410. The thickness of the region 1440 allows the sleeve 600 to self-seal after the tube 1401 is pulled out of the inner volume 610. Additionally, the region 1440 can also include a preformed slit that is designed to self-seal after the tube 1401 is removed from the inner volume 610.

Figure 17:
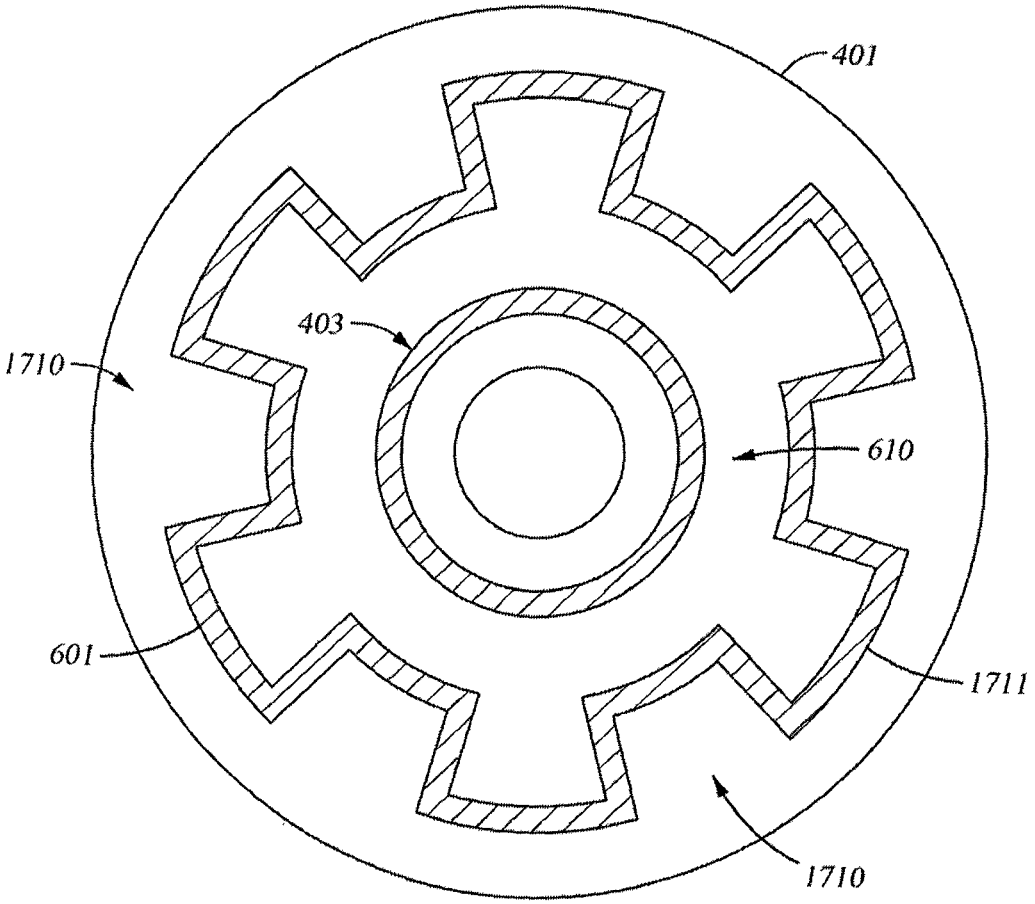
FIG. 17 is a cross-sectional view of the customizable ear insert taken across the sectioning line shown in FIG. 6, according to at least one embodiment.

FIG. 17 is a cross-sectional view of the customizable ear insert 102 taken across the sectioning line 17-17 shown in FIG. 6, according to at least one embodiment. To prevent the undesirable collapse and/or folding of portions of the sleeve 600 when pressure is applied by the user during the insertion of the ear insert 102 within the ear of a user, in some embodiments, the sleeve assembly 401 is designed such that there are ribs or shaped contours within the sleeve assembly 401 that are configured to control the bending or deformation of portions of the sleeve 600. The ribs or shaped contours within the sleeve assembly 401 can be formed and configured to prevent unwanted bending or deformation for a large percentage of the population based on the common shape(s) of most users' ears. As shown in FIG. 17, the contouring sections or ribs include internal alternating inner sections 1710 and outer sections 1711, creating contouring sections or ribs that run from the ear tip portion 412 to the opposing end 413 within the sleeve assembly 401. The contouring sections or ribs may alternately or additionally be aligned in a direction that is at an angle (e.g., perpendicular) to a direction that extends from the ear tip portion 412 to the opposing end 413 (e.g., "hoop" direction in the ear tip portion). The contouring sections or ribs can help control the bending stiffness of the sleeve assembly 401 in different regions of the sleeve assembly 401, or can eliminate the collapsing of the sleeve assembly 401 in certain regions.

In other embodiments, the sleeve assembly 401 is configured to include different thicknesses in different regions of the sleeve 600 of the sleeve body. The control of different thickness of the sleeve 600 can also help prevent or eliminate collapsing of the sleeve assembly 401 during its insertion into the user's ear. For example, as shown in FIG. 6, the sleeve 600 includes a first region 691 and a second region 692. The first region 691 can be some amount thicker than the second region 692, for example, the first region 691 can be two times as thick as the second region 692. In one example, the thickness of the first region 691 can be about 0.3 mm and the thickness of the second region 692 can be about 0.15 mm, however these thicknesses can vary. Controlling the thickness in different regions of the sleeve 600 can help control the amount of compression within different portions of sleeve that will then direct the flow of curable filler material into different regions of the sleeve 600 when pressure is applied to the sleeve 600, such as when a user urges the sleeve 600 against the inner part of the users ear. The thicknesses of the sleeve 600 can be controlled or created during one or more of the processes described in block 3002 of the method 3000. For example, the thicker first region 691 does not deflect as much as the thinner second region 692 when pressure is applied by the user. As such, the second region 692 will receive more curable filler material 801 due to its greater ability to flex under the applied pressure, which can leads to better support in a user's ears. Additionally, controlling the thickness of the sleeve 600 in these embodiments improves overall retention and comfort of the ear insert 102. In some embodiments, the transition between the first region 691 and the second region 692 is gradual. However, this transition can also be more immediate.

In some embodiments, referring to FIGS. 1B and 6, the second region 692 is defined by the portion of the sleeve assembly 401 that is positioned against surfaces of the ear canal 2 and the first region 691 is defined by portions of the sleeve assembly 401 that are positioned against surfaces of the cavum conchae 3 and the cymba conchae 4. The transition between the first region 691 and a second region 692 may be positioned at or between the entrance to the ear canal 2 and a central portion of the cavum conchae 3. In some embodiments, a portion of the second region 692 extends over the crus helix 5 to allow some compliance in this region of the body portion 415 of the sleeve assembly 401, and thus allow the region of the body portion 415 to conform to at least the surfaces of the crus helix 5. Additionally, portions of the second region 692 may be located in areas corresponding to the tragus 10, antitragus 12, and inter-tragic notch (not shown) to improve flexibility or compliance in these areas.

While the foregoing is directed to embodiments of the present disclosure, other and further embodiments of the disclosure may be devised without departing from the basic scope thereof, and the scope thereof is determined by the claims that follow.

What is claimed is:

1. An audio device, comprising an earphone assembly comprising:

an ear insert comprising:

a sleeve body having an inner surface, and comprising an elastic material and a reflective material configured to reflect one or more wavelengths of light;

a sound tube that is coupled to the sleeve body, wherein the inner surface of the sleeve body and an outer surface of the sound tube at least partially define an inner volume of the ear insert; and a curable filler material disposed within the inner volume; and one or more radiation sources positioned to emit the one or more wavelengths of light through a portion of the sleeve body and into the curable filler material disposed within the inner volume, wherein the portion of the sleeve body does not include the reflective material and the curable filler material is configured to be cured by the emitted one or more wavelengths of light; and an audio assembly comprising:

an audio driver configured to deliver audible sound to an inner surface of the sound tube, and the audio assembly is separably coupled to the ear insert.

2. The audio device of claim 1, wherein the reflective material comprises a reflective coating disposed over the inner surface of the sleeve body.

3. The audio device of claim 1, further comprising a portable power source configured to power the audio driver and the radiation source.

4. The audio device of claim 3, wherein the audio assembly further comprises:

a processor coupled to a memory, wherein the memory includes instructions which when executed by the processor are configured to perform a method comprising: causing the portable power source to provide power the radiation source for a first period of time.

5. The audio device of claim 1, wherein the sleeve body further comprises a body portion that is disposed between an ear tip portion, which is configured to be inserted within an ear canal of a user's ear, and a fin portion that is configured to be positioned against a cymba conchae of the user's ear.

6. The audio device of claim 1, wherein the audio device further comprises at least one more radiation source that is disposed within the inner volume of the ear insert, and the radiation source and the at least one more radiation source are spaced apart from each other within the inner volume.

7. The audio device of claim 6, wherein the radiation source and the at least one more radiation source are disposed on a flexible printed circuit board.

8. The audio device of claim 1, wherein the audio assembly further comprises:

a housing that encloses the audio driver, wherein a portion of the housing is configured to be disposed within an opening formed within the ear insert that is positioned adjacent to an input region of the sound tube.

9. The audio device of claim 1, wherein the audio device further comprises:

a controller assembly that comprises one or more electrical components that are in communication with the audio driver of the audio assembly; and the audio assembly further comprises a housing that encloses the audio driver, wherein the controller assembly is coupled to the housing via a cable.

10. The audio device of claim 1, further comprising:

a housing that encloses the audio driver; and a portable power source configured to power the audio driver and the radiation source, wherein the portable power source is coupled to the housing via a cable.

11. The audio device of claim 1, wherein the audio assembly is separably coupled to the ear insert by a connector that couples the ear insert to the audio assembly at a connection point disposed on the audio assembly.

12. The audio device of claim 1, wherein the sleeve body further comprises one or more ribs that are formed on the inner surface of a sleeve of the sleeve body.

13. The audio device of claim 1, wherein the sleeve body further comprises a body portion and an ear tip portion, wherein the sleeve body has a first thickness within the ear tip portion and a second thickness, which is different from the first thickness, within the body portion.

14. The audio device of claim 1, wherein the audio assembly further comprises:

a housing that encloses the audio driver, and wherein the radiation source is disposed within the housing.

15. An audio device, comprising:

two earphone assemblies, wherein each earphone assembly comprises an ear insert, an audio assembly, and one or more radiation sources, wherein each of the ear inserts comprise:

a sleeve body having an inner surface, and comprising an elastic material and a reflective material which is configured to reflect one or more wavelengths of light;

a sound tube that is coupled to the sleeve body, wherein the inner surface of the sleeve body and an outer surface of the sound tube at least partially define an inner volume of the ear insert; and a curable filler material disposed within the inner volume;

wherein the one or more radiation sources are positioned to emit the one or more wavelengths of light through a portion of the sleeve body and into the curable filler material disposed within the inner volume, wherein the portion of the sleeve body does not include the reflective material and the curable filler material is configured to be cured by the emitted one or more wavelengths of light; and wherein the audio assembly comprises:

an audio driver configured to deliver audible sound to an inner surface of the sound tube, wherein an external surface of the sleeve body in a first of the two earphone assemblies has a shape that is different from a shape of an external surface of the sleeve body in a second of the two earphone assemblies.

16. The audio device of claim 15, wherein the audio assembly further comprises a portable power source configured to power the audio driver and the radiation source.

17. The audio device of claim 16, wherein the audio device further comprises:

a controller assembly that comprises one or more electrical components that are in communication with the audio driver, and the audio assembly within each of the two earphone assemblies further comprises a housing that encloses the audio driver, wherein the controller assembly is coupled to the housing via a cable.

18. An audio device comprising:

two earphone assemblies, wherein each earphone assembly comprises an ear insert and an audio assembly, wherein each of the ear inserts comprise:

a sleeve body having an inner surface, and comprising an elastic material and a reflective material which is configured to reflect one or more wavelengths of light emitted by a radiation source;

a sound tube that is coupled to the sleeve body, wherein the inner surface of the sleeve body and an outer surface of the sound tube at least partially define an inner volume of the ear insert; and a curable filler material disposed within the inner volume, wherein the curable filler material is configured to be cured by the one or more wavelengths of light emitted by the radiation source, and wherein the audio assembly comprises:

an audio driver configured to deliver audible sound to an inner surface of the sound tube;

a portable power source configured to power the audio driver and the radiation source; and a housing that encloses the audio driver; and a controller assembly that comprises one or more electrical components that are in communication with the audio driver, wherein:

the controller assembly is coupled to the housing via a cable, an external surface of the sleeve body in a first of the two earphone assemblies has a shape that is different from a shape of an external surface of the sleeve body in a second of the two earphone assemblies, the controller assembly is coupled to the housing via a cable, and the portable power source is disposed within the controller assembly, wherein the cable comprises one or more wires that electrically connect the audio driver, within each of the audio assemblies, to the portable power source.

19. The audio device of claim 15, wherein each of the sleeve bodies further comprises a body portion that is disposed between an ear tip portion, which is configured to be inserted within an ear canal of a user's ear, and a fin portion, which is configured to be positioned against a cymba conchae of the user's ear.

20. The audio device of claim 19, wherein the shapes of the sleeve bodies in the first and second of the two earphone assemblies are a mirror image of each other before the curable filler material is cured by the radiation source.

21. The audio device of claim 15, wherein each of the ear inserts further comprise at least one more radiation source that is disposed within the inner volume, and the radiation source and the at least one more radiation source within each of the ear inserts are spaced apart from each other within the inner volume.

22. The audio device of claim 15, wherein the audio assembly within each of the two earphone assemblies further comprise:

a housing that encloses the audio driver, and wherein the radiation source is disposed within the housing.

23. The audio device of claim 15, wherein the audio assembly within each of the two earphone assemblies further comprises:

a housing that encloses the audio driver, wherein a portion of the housing is configured to be disposed within an opening formed within the ear insert that is positioned adjacent to an input region of the sound tube.

24. The audio device of claim 15, wherein each of the ear inserts further comprise a connector that separably couples the ear insert to the audio assembly at a connection point on the audio assembly.

25. The audio device of claim 15, wherein the audio assembly further comprises:

a portable power source configured to power the audio driver and the radiation source; and a processor coupled to a memory, wherein the memory includes instructions which when executed by the processor are configured to perform a method comprising:

causing the portable power source to provide power the radiation source for a first period of time.

26. The audio device of claim 15, wherein each of the sleeve bodies further comprise a body portion and an ear tip portion, wherein each of the sleeve bodies have a first thickness within the ear tip portion and a second thickness, which is different from the first thickness, within the body portion.

27. The audio device of claim 1, further comprising one or more optical lenses positioned adjacent to each of the one or more radiation sources, the one or more optical lenses configured to disperse the one or more wavelengths of light through the inner volume.

28. The audio device of claim 15, further comprising one or more optical lenses positioned adjacent to each of the one or more radiation sources, the one or more optical lenses configured to disperse the one or more wavelengths of light through the inner volume.

29. The audio device of claim 15, wherein the audio device further comprises:

a controller assembly that comprises one or more electrical components that are in communication with the audio driver; and a portable power source disposed within the controller assembly, the portable power source configured to power the audio driver and the radiation source, wherein the controller assembly is coupled to a housing via a cable comprising one or more wires that electrically connect the audio driver, within each of the audio assemblies, to the portable power source.

30. An audio device, comprising an earphone assembly comprising:

an ear insert comprising:

a sleeve body having an inner surface, and comprising an elastic material and a reflective material which is configured to reflect one or more wavelengths of light emitted by a radiation source;

a sound tube comprising and inner surface and an outer surface and is coupled to the sleeve body, wherein the inner surface of the sleeve body and the outer surface of the sound tube at least partially define an inner volume of the ear insert;

a curable filler material disposed within the inner volume, wherein the curable filler material is configured to be cured by the one or more wavelengths of light emitted by the radiation source; and one or more radiation sources positioned to emit the one or more wavelengths of light through a first portion of the sound tube and into a central region, which is at least partially defined by the inner surface of the sound tube, and then into the inner volume through a second portion of the sound tube; and an audio assembly comprising:

an audio driver configured to deliver audible sound to an inner surface of the sound tube, and the audio assembly is separably coupled to the ear insert.

31. The audio device of claim 30, wherein the sound tube comprises a self-sealing material.

32. The audio device of claim 30, wherein the sleeve body comprises a self-sealing region that is configured to be punctured by a tube and has a thickness that is greater than any other portion of the sleeve body.

33. The audio device of claim 30, further comprising a fiber optic cable having a first end and a second end, wherein the first end is configured to receive the one or more wavelengths of light emitted by a radiation source and the second end is configured to emit the one or more wavelengths of light received at the first end into the inner volume.

34. The audio device of claim 33, wherein the first end of the fiber optic cable is positioned outside of the inner volume.

* * * * *